US009091474B2

(12) United States Patent
Ide et al.

(10) Patent No.: US 9,091,474 B2
(45) Date of Patent: Jul. 28, 2015

(54) STORAGE CONTAINER

(75) Inventors: Tetsuya Ide, Osaka (JP); Yuka Utsumi, Osaka (JP); Tomoko Kase, Osaka (JP); Mitsuhiro Koden, Osaka (JP); Shigeaki Mizushima, Osaka (JP); Katsumi Kondoh, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 310 days.

(21) Appl. No.: 13/988,410

(22) PCT Filed: Nov. 22, 2011

(86) PCT No.: PCT/JP2011/076896

§ 371 (c)(1),
(2), (4) Date: May 20, 2013

(87) PCT Pub. No.: WO2012/070567

PCT Pub. Date: May 31, 2012

(65) Prior Publication Data

US 2013/0239606 A1 Sep. 19, 2013

(30) Foreign Application Priority Data

Nov. 24, 2010 (JP) ..... 2010-261689

(51) Int. Cl.
*F25D 19/00* (2006.01)
*F25D 11/00* (2006.01)
*F25D 16/00* (2006.01)

(52) U.S. Cl.
CPC ..... *F25D 11/00* (2013.01); *F25D 16/00* (2013.01)

(58) Field of Classification Search
CPC ..... F25B 39/05; F25D 3/08; F25D 11/00
USPC ..... 62/371, 453, 457.2, 457.7, 457.9, 462; 220/595.26
See application file for complete search history.

(56) References Cited

U.S. PATENT DOCUMENTS 2,550,040 A * 4/1951 Clar ..... 165/63
3,167,933 A * 2/1965 Beckman et al. ..... 62/371
(Continued)

FOREIGN PATENT DOCUMENTS

JP 58-219379 A 12/1983
JP 02-290520 A 11/1990
(Continued)

OTHER PUBLICATIONS

Official Communication issued in International Patent Application No. PCT/JP2011/076896, mailed on Dec. 27, 2011.

*Primary Examiner* — Melvin Jones
(74) *Attorney, Agent, or Firm* — Keating & Bennett, LLP

(57) ABSTRACT

A storage container can maintain a temperature inside a storage room not to cause a temperature distribution for a certain time even if the operation is stopped. In a storage container 1 storing preserved goods and having an electrical cooling function, the storage container 1 includes a container body 10 and a door 20. A space enclosed by the container body 10 and the door 20 forms a storage room 100. The container body 10 and the door 20 have respectively heat insulating portions 12, 22 and heat accumulating portions 14, 24. The heat accumulating portions 14, 24 are each made of at least one type of material that causes liquid-solid phase transition at a temperature between a controllable temperature inside the storage room 100 and a living environmental temperature. A value obtained by dividing temperature conductivity of the material by an amount of the material used per unit area of a wall surface of the storage room 100 is smaller in the heat accumulating portions 14, 24 arranged near a first area where a temperature is more apt to come closer to the living environmental temperature under a temperature distribution that is formed inside the storage room 100 with changes over time after stop of cooling, than in the heat accumulating portions 14, 24 arranged near a second area where a temperature is less apt to come closer to the living environmental temperature thereunder.

19 Claims, 27 Drawing Sheets

(56) References Cited

U.S. PATENT DOCUMENTS

| | | | | |
|---|---|---|---|---|
| 5,021,981 | A | 6/1991 | Swartzel et al. | |
| 5,159,564 | A | 10/1992 | Swartzel et al. | |
| 2002/0020188 | A1* | 2/2002 | Sharon et al. | 62/371 |
| 2005/0016198 | A1* | 1/2005 | Wowk et al. | 62/371 |
| 2005/0188715 | A1* | 9/2005 | Aragon | 62/371 |

FOREIGN PATENT DOCUMENTS

| | | | |
|---|---|---|---|
| JP | 07-004807 | A | 1/1995 |
| JP | 09-303931 | A | 11/1997 |
| JP | 2001-043434 | A | 2/2001 |

* cited by examiner (a)

(b)

(a)

(b)

(a)

(b)

(a)

(b)

(a)

(b)

(a)

(b)

(a)

(b)

(a)

(b)

(a)

(b)

(a)

(b)

(a)

(b)

STORAGE CONTAINER

TECHNICAL FIELD

The present invention relates to a storage container.

BACKGROUND ART

Hitherto, there is known a storage container, e.g., a refrigerator and a heating cabinet, for storing preserved goods at a temperature different from the ambient air temperature. By employing such a storage container, the preserved goods can be stored at a desired temperature. In the case of a refrigerator, for example, freshness of various foods as the preserved goods can be kept for a long time. In the case of a heating cabinet, foods as the preserved goods can be kept at a temperature suitable for eating (e.g., 80° C.).

In the above-described storage container, if the operation is stopped due to, e.g., a power failure, a temperature inside a storage room for storing the preserved goods comes closer to the ambient air temperature. Namely, the storage room temperature rises in the refrigerator and falls in the heating cabinet. To prevent such a temperature change, Patent Literatures 1 and 2 propose refrigerators including cold storage materials and constructed such that, even if the operation is stopped due to, e.g., a power failure, cold air is supplied to the inside of the refrigerator for a certain time, thus holding the temperature inside the storage room to be not changed.

CITATION LIST

Patent Literature

PTL 1: Japanese Unexamined Patent Application Publication No. 58-219379

PTL 2: Japanese Unexamined Patent Application Publication No. 7-4807

SUMMARY OF INVENTION

Technical Problem

In each of the structures described in PTLs, the cold storage material is uniformly arranged so as to surround the storage room. It is, however, easily inferred that, when heat enters the storage room of the storage container in an operation stopped state from the outside, an amount of inflow heat is not uniform over the entire storage room. This may lead to a possibility that a temperature distribution occurs inside the storage room with the lapse of time and the cold keeping function with the cold storage material is not developed in some places within the storage room.

The present invention has been made in view of the above-mentioned state of the art, and one object of the present invention is to provide a storage container capable of maintaining a temperature inside a storage room not to cause a temperature distribution for a certain time even if the operation is stopped.

Solution to Problem

To solve the above-described problem, according to one aspect of the present invention, there is provided a storage container storing preserved goods and having an electrical cooling function, the storage container including a container body and a lid capable of optionally opening and closing a space in the container body, wherein the space enclosed by the container body and the lid forms a storage room for storing the preserved goods, each of the container body and the lid has a heat insulating portion disposed to surround the storage room and a heat accumulating portion at least partly disposed between the storage room and the heat insulating portion, the heat accumulating portion is made of at least one type of material that causes phase transition between a liquid phase and a solid phase at a temperature between a controllable temperature inside the storage room during a stationary operation and a living environmental temperature around the storage room, and a value obtained by dividing temperature conductivity of the material by an amount of the material used per unit area of a wall surface of the storage room is smaller in the heat accumulating portion arranged near a first area where a temperature is more apt to come closer to the living environmental temperature under a temperature distribution that is formed inside the storage room with changes over time after the electrical cooling function is stopped in a stationary operation state, than in the heat accumulating portion arranged near a second area where a temperature is less apt to come closer to the living environmental temperature under the temperature distribution.

According to one aspect of the present invention, based on a relation between a dimensionless temperature and a Fourier number of a wall material constituting each of the container body and the lid, the dimensionless temperature being defined as a value resulting from dividing a difference between an allowable temperature that is a temperature inside the storage room after stop of the electrical cooling function and that is allowed as a temperature at which the preserved goods can be stored, and the living environmental temperature by a difference between the aforesaid controllable temperature and the living environmental temperature, a thickness of the heat accumulating portion is specified corresponding to a temperature retainable time during which the temperature inside the storage room changes from the aforesaid controllable temperature to the aforesaid allowable temperature after stop of the operation.

According to one aspect of the present invention, preferably, the storage container is a refrigerator, and the allowable temperature is 10° C. or below.

According to one aspect of the present invention, preferably, the storage container is a freezer, and the allowable temperature is −10° C. or below.

According to one aspect of the present invention, preferably, the temperature retainable time is 2 hours to 24 hours.

According to one aspect of the present invention, preferably, the heat accumulating portion is made of plural types of materials, and the material of the heat accumulating portion disposed near the first area has smaller temperature conductivity at a phase transition temperature than the material of the heat accumulating portion disposed near the second area.

According to one aspect of the present invention, preferably, the heat accumulating portion disposed near the first area is disposed to have a larger total amount of latent heat than the heat accumulating portion disposed near the second area.

According to one aspect of the present invention, preferably, the first area is a contact portion between the container body and the lid when the lid is closed.

According to one aspect of the present invention, preferably, the first area is a ceiling portion of the storage room.

According to one aspect of the present invention, there is provided a storage container storing preserved goods and having an electrical cooling function, the storage container including a container body and a lid capable of optionally opening and closing a space in the container body, wherein the space enclosed by the container body and the lid forms a storage room for storing the preserved goods, each of the container body and the lid has a heat insulating portion disposed to surround the storage room and a heat accumulating portion at least partly disposed between the storage room and the heat insulating portion, the heat accumulating portion is made of at least one type of material that causes phase transition between a liquid phase and a solid phase at a temperature between a controllable temperature inside the storage room during a stationary operation and a living environmental temperature around the storage container, and based on a relation between a dimensionless temperature and a Fourier number of a wall material constituting each of the container body and the lid, the dimensionless temperature being defined as a value resulting from dividing a difference between an allowable temperature that is a temperature inside the storage room after stop of the electrical cooling function and that is allowed as a temperature at which the preserved goods can be stored, and the living environmental temperature by a difference between the aforesaid controllable temperature and the living environmental temperature, a thickness of the heat accumulating portion in a region occupying a maximum area in the storage container is specified corresponding to a temperature retainable time during which the temperature inside the storage room changes from the aforesaid controllable temperature to the aforesaid allowable temperature after stop of the electrical cooling function.

According to one aspect of the present invention, preferably, the storage container is a refrigerator, and the allowable temperature is 10° C. or below.

According to one aspect of the present invention, preferably, the storage container is a freezer, and the allowable temperature is −10° C. or below.

According to one aspect of the present invention, preferably, the temperature retainable time is 2 hours to 24 hours.

According to one aspect of the present invention, preferably, a peak temperature of a phase transition temperature when the aforesaid material is solidified is −20° C. to −10° C.

According to one aspect of the present invention, preferably, a peak temperature of a phase transition temperature when the aforesaid material is solidified is 0° C. to 10° C.

According to one aspect of the present invention, preferably, a phase transition temperature zone of the aforesaid material when the phase transition occurs from the liquid phase to the solid phase between a setting temperature of the storage room during the stationary operation and the living environmental temperature is 2° C. or below.

According to one aspect of the present invention, preferably, the heat accumulating portion includes a first heat accumulating portion disposed to surround the storage room, and a second heat accumulating portion disposed between the heat insulating portion and the first heat accumulating portion to surround the storage room, and a material of the second heat accumulating portion has a phase transition temperature closer to the living environmental temperature than a material of the first heat accumulating portion.

According to one aspect of the present invention, preferably, a phase transition temperature of the aforesaid material is lower than the living environmental temperature, and at least a part of an inner wall of the storage room is covered with an infrared reflecting layer that reflects 60% or more of infrared rays having a peak wavelength at a wavelength corresponding to a surface temperature of a human body.

According to one aspect of the present invention, preferably, the infrared reflecting layer is made of a metal material, and at least a part of the inner wall of the storage room is made of the metal material to serve as the infrared reflecting layer and is contacted with the heat accumulating portion.

Advantageous Effects of Invention

According to the present invention, the storage container capable of maintaining the temperature inside the storage room not to cause a temperature distribution can be provided.

DESCRIPTION OF EMBODIMENTS

[First Embodiment]

A storage container according to a first embodiment of the present invention will be described below with reference to FIGS. 1 to 17. It is to be noted that, in all the drawings described below, dimensions, proportions and so on of various components are illustrated on different basis, as appropriate, for easier understanding of the drawings.

Figure 1:
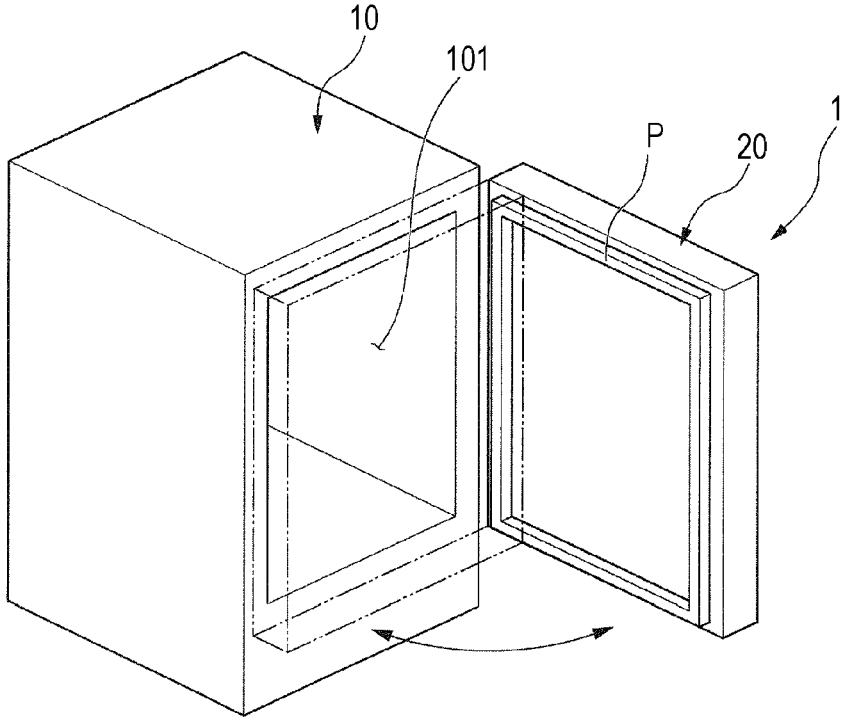
FIG. 1 is an explanatory view illustrating a storage container according to a first embodiment.
Figure 1:
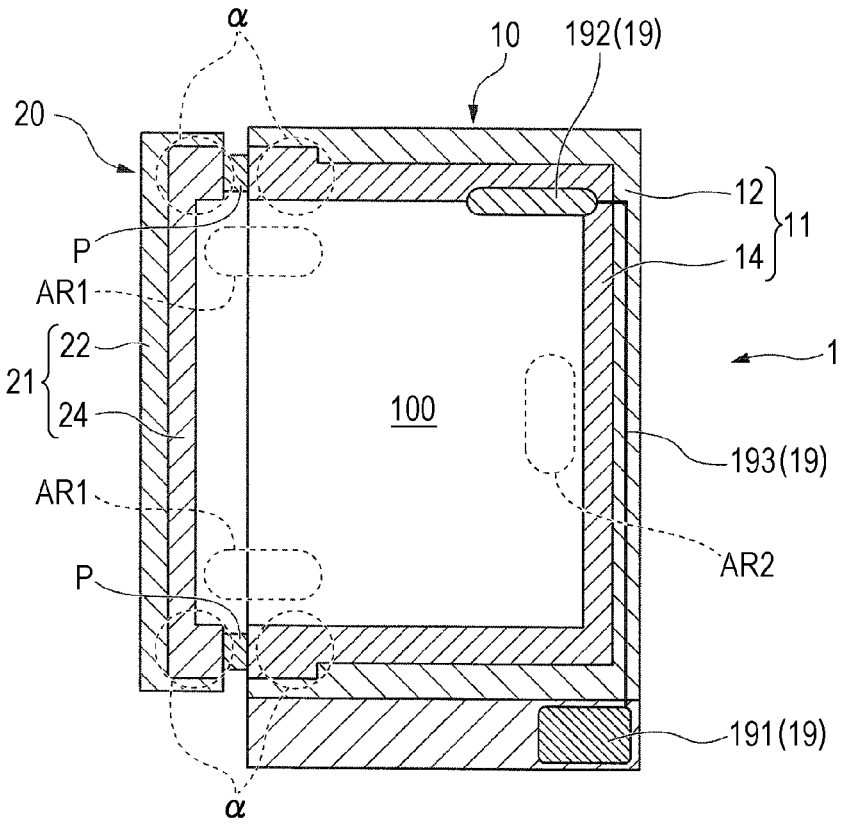

FIG. 1 is an explanatory view illustrating a storage container 1 according to the first embodiment. More specifically, FIG. 1(*a*) is a schematic perspective view, and FIG. 1(*b*) is a schematic sectional view. The storage container 1 is used to store preserved goods at a temperature different from the ambient air temperature (living environmental temperature) during stationary operation. Examples of the storage container 1 are a refrigerator, a freezer, and a heating cabinet. This embodiment is described on an assumption that the storage container 1 is a refrigerator.

As illustrated in the drawings, the storage container 1 of this embodiment includes a container body 10 having a storage room 100 accessible from the outside through an opening 101, and a door (lid) 20 attached to the opening 101. The storage room 100 is a space enclosed by a wall member 11 constituting the container body 10, and by a wall member 21 constituting the door 20. The container body 10 includes a heat insulating portion 12 and a heat accumulating portion 14. The door 20 also includes a heat insulating portion 22 and a heat accumulating portion 24. The heat accumulating portion 14 and the heat accumulating portion 24 are disposed to have a larger thickness (volume) at positions adjacent to a packing P than at other positions.

In the storage container 1 of this embodiment, during stationary operation, the inside of the storage room 100 can be held at a predetermined setting temperature. Furthermore, even if supply of electric power is interrupted due to, e.g., a power failure and the operation is stopped, the cold keeping function can be developed such that the temperature inside the storage room 100 does not cause a temperature distribution for a certain time. Such a point will be described in detail below.

The container body 10 includes the wall member 11 and a cooling device 19 for cooling the inside of the storage room 100. The wall member 11 includes the heat insulating portion 12 disposed to surround the storage room 100, and the heat accumulating portion 14 disposed between the storage room 100 and the heat insulation portion 12 to surround the storage room 100. Those portions 12 and 14 are contained in a space defined by a casing (not illustrated) made of a resin material, e.g., an ABS resin.

The heat insulating portion 12 serves to provide heat insulation such that heat is not transferred through the casing from the outside to the storage room 100 and the heat accumulating portion 14, which are cooled during the stationary operation. The heat insulating portion 12 can be formed using commonly known materials, e.g., fiber-based heat insulating materials such as glass wool, resin foam-based heat insulating materials such as polyurethane foam, and natural fiber-based heat insulating materials such as cellulose fiber.

The heat accumulating portion 14 is formed using, as a heat accumulating material, a material that causes liquid-solid phase transition at a temperature between the setting temperature of the storage room 100 and the ambient air temperature. Here, the term "setting temperature of the storage room 100" implies a temperature set for the storage room 100 when the storage container 1 is under the stationary operation. The term "ambient air temperature" implies a temperature that is estimated as, e.g., an atmospheric temperature in environment where the storage container 1 is used. Assuming, for example, that the storage container 1 is a refrigerator having the setting temperature of 4° C. and the estimated ambient air temperature is 25° C., the heat accumulating portion 14 is formed using a heat accumulating material that has a solid-liquid phase transition temperature of higher than 4° C. and lower than 25° C.

Figure 2:
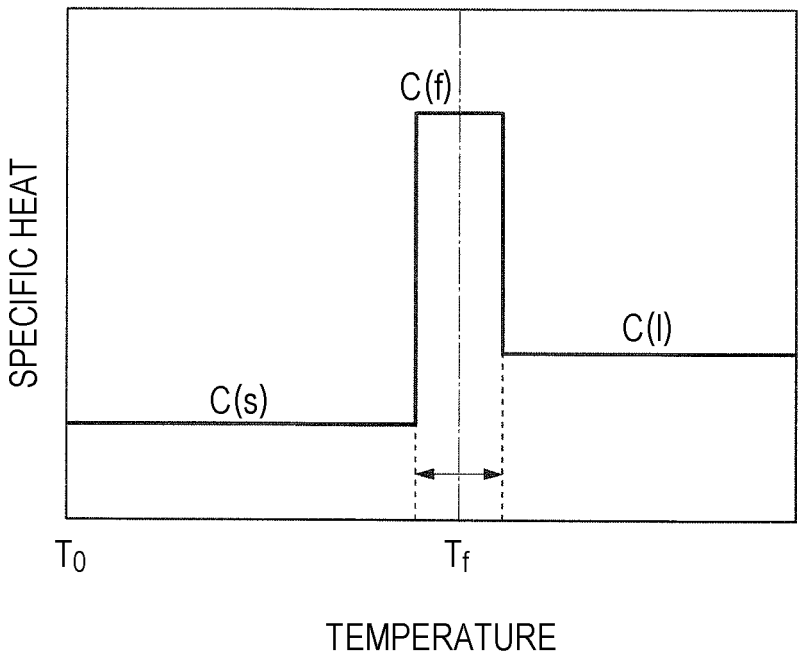
FIG. 2 is a graph diagrammatically depicting a thermal behavior when a material of a heat accumulating portion causes a phase transition.

FIG. 2 is a graph diagrammatically depicting a thermal behavior when the heat accumulating material of the heat accumulating portion 14, illustrated in FIG. 1, causes the phase transition. In the graph, the horizontal axis represents temperature, and the vertical axis represents specific heat.

In more detail, the heat accumulating material raises its temperature by absorbing heat in amount corresponding to specific heat C(s) when it is in a solid state (solid phase), and also raises its temperature by absorbing heat in amount corresponding to specific heat C(l) when it is in a liquid state (liquid phase). On the other hand, the heat accumulating material raises its temperature by absorbing heat in amount corresponding to latent heat at a temperature at which the heat accumulating material causes the phase transition.

Here, the term "specific heat" implies an amount of heat required to raise a temperature of a substance in unit mass by a unit temperature. Thus, in a temperature zone where the phase transition occurs, an amount of heat to be absorbed to raise temperature by the unit temperature corresponds to the latent heat. It is hence deemed that, in a phase transition temperature zone Tf, the heat accumulating material raises its temperature by the unit temperature by absorbing heat in amount corresponding to specific heat C(f) and the specific heat of the heat accumulating material is increased as illustrated in FIG. 2. Therefore, when the phase transition temperature of the heat accumulating material is a temperature between the setting temperature of the storage room 100 and the ambient air temperature, the temperature inside the storage room 100 reaches the phase transition temperature zone Tf in a temperature rising process of the temperature inside the storage room 100 after stop of the operation, and temperature change can be suppressed for a long time in the phase transition temperature zone.

The heat accumulating material is made of a material having the phase transition temperature zone Tf covering appropriate temperatures depending on the setting temperature of the storage room 100, i.e., specifications of the storage container 1.

In the case of a refrigerator, for example, like the storage container 1 of this embodiment, the setting temperature of the storage room (refrigerating room) is desirably 10° C. or lower, and a peak temperature of the phase transition temperature of the heat accumulating material is preferably 0° C. to 10° C.

When the storage container stores the preserved goods at a temperature lower than in the refrigerating room, the phase transition temperature zone of the heat accumulating material is preferably 2° C. or lower. For example, when the storage room is a chilling room, a peak temperature of the phase transition temperature of the heat accumulating material is preferably 0° C. to 2° C. because the setting temperature is about 0° C. When the storage room is a freezing room, the setting temperature of the storage room (freezing room) is desirably −10° C. or lower, and a peak temperature of the phase transition temperature of the heat accumulating material is preferably −20° C. to −10° C.

The phase transition temperature of the heat accumulating material can be measured using a differential scanning calorimeter (DSC). The above-mentioned peak temperature can be determined, for example, as a peak temperature obtained when the phase transition from the liquid to solid phase occurs on condition that the measurement is performed at a temperature lowering rate of 1° C./min using the differential scanning calorimeter.

The phase transition temperature zone is a temperature zone where the phase transition from the liquid to solid phase occurs at a temperature between the setting temperature of the storage room 100 during the stationary operation and the ambient air temperature.

The heat accumulating material having the above-mentioned phase transition temperature is cooled to the phase transition temperature or below by cold air filled in the storage room 100 with the storage room 100 cooled during the stationary operation, and it is brought into the solid phase during the stationary operation. On the other hand, even if the operation of the storage container 1 is stopped, the heat accumulating material supplies cold air to the inside of the storage room 100 for a certain time. As a result, temperature change in the storage room 100 can be suppressed.

The heat accumulating material can be any of commonly known materials, e.g., water, paraffin, 1-decanol, $SO_2.6H_2O$, $C_4H_3O.17H_2O$, and $(CH)_23N.10¼H_2O$. Furthermore, the heat accumulating material having the desired phase transition temperature can be prepared through appropriate adjustment utilizing a freezing point depression that is caused by dissolving a solute in a liquid heat accumulating material. Additionally, the heat accumulating material may be made of one type of material or a combination of two or more types of materials selected from the above-mentioned examples.

Figure 3:
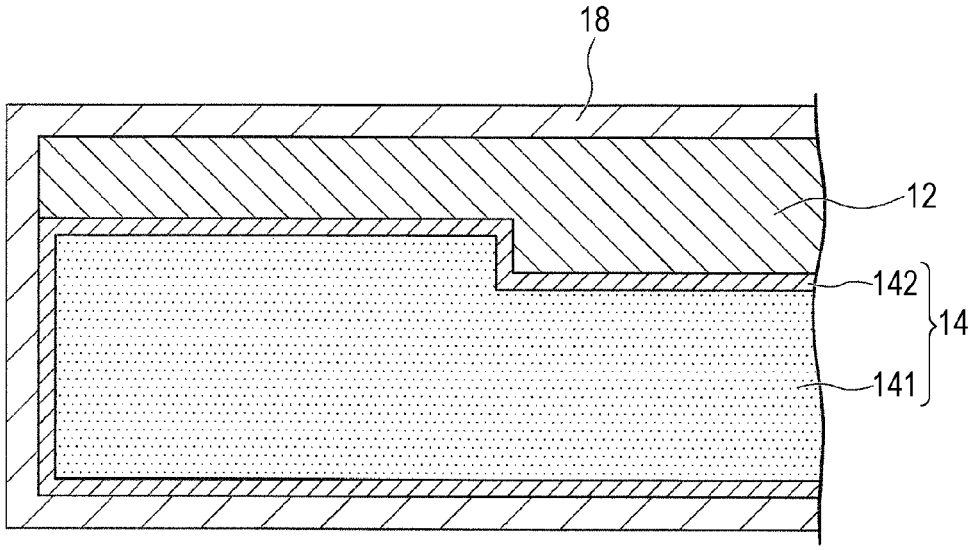
FIG. 3 is an explanatory view illustrating the storage container according to the first embodiment.
Figure 3:
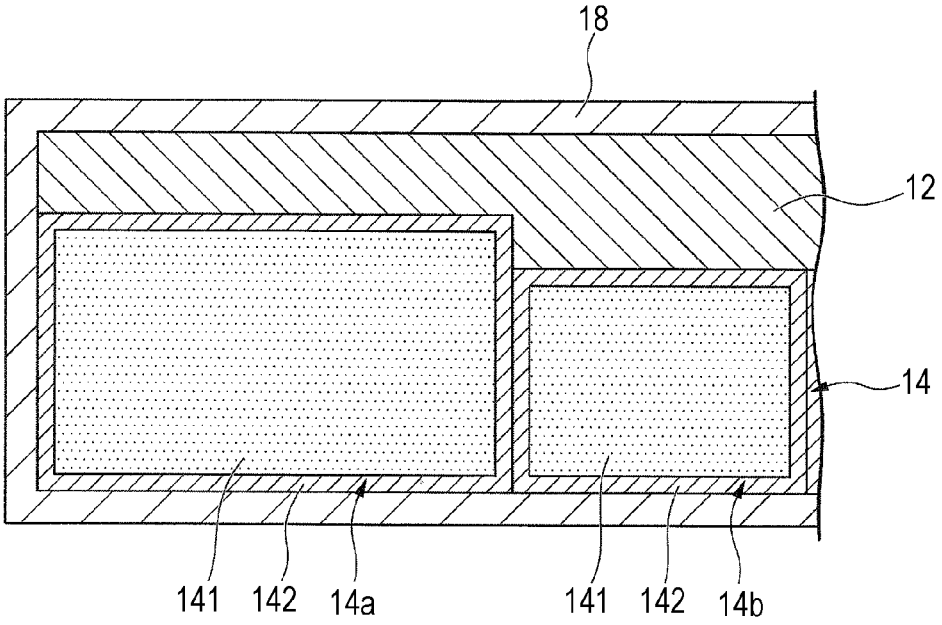

FIGS. 3(*a*) and 3(*b*) are explanatory views illustrating the structure of the wall member 11. As illustrated in FIG. 3(*a*), the heat accumulating portion 14 can be constituted by a heat accumulating material 141 and a protective film 142 covering the heat accumulating material 141, and can be filled in a space between the casing 18 of the container body 10 and the heat insulating portion 12 disposed inside the casing 18. Alternatively, as illustrated in FIG. 3(*b*), the heat accumulating portion 14 may be formed by filling a plurality of small blocks (denoted by 14*a* and 14*b*), each of which is formed by the heat accumulating material 141 and the protective film 142, in the space between the casing 18 and the heat insulating portion 12.

The heat accumulating material 141 may be constituted to be able to retain its shape through gelling, for example, when solid-phase phase change occurs. In this case, since it is possible to retain the shape and to prevent leakage with the heat accumulating material 141 alone, the protective film 142 is not necessarily required.

Moreover, the heat accumulating material 141 may be constituted in the form of slurry through microcapsulation, for example. In this case, since volume change with solid-liquid phase change is prevented, thermal resistance at a contact interface between the heat accumulating material 141 and another member can be held constant.

Returning to FIG. 1, the cooling device 19 is a gas-compression type cooling device and is disposed at the bottom of the container body 10. The cooling device 19 includes a compressor 191 for compressing a coolant, a cooling unit 192 disposed in a state exposed to the inside of the storage room 100 and cooling the surroundings due to evaporation heat taken when the compressed coolant evaporates therein, and a pipe 193 connecting the compressor 191 and the cooling unit 192 to each other. In addition, the cooling device 19 may include other commonly known units, such as a condenser for radiating heat from the compressed coolant, and a drier for removing moisture in the coolant.

While the gas-compression type cooling device is illustrated here, the type of the cooling device is not limited to the illustrated one, and the cooling device may be of the gas absorption type or the electronic type using a Peltier element. Furthermore, the storage container 1 is illustrated as being of the direct cooling type (cold-air natural convection type) in which the cooling unit 192 is exposed to the storage room 100. However, the storage container 1 is not limited to that type, and it may be of the indirect cooling type (cold-air forced circulation type) in which the storage room 100 is cooled by circulating cold air, cooled by the cooling unit 192, with a fan.

On the other hand, the door 20 is rotatably attached to the container body 10 through a connector (not illustrated), e.g., a hinge, such that the opening 101 is opened and closed. The door 20 includes the packing P on the side coming into contact with the container body 10 when the door 20 is closed.

The door 20 has the wall member 21, which includes the heat insulating portion 22 disposed to surround the storage room 100, and the heat accumulating portion 24 disposed between the storage room 100 and the heat insulation portion 22 to surround the storage room 100, as in the container body 10. The heat insulating portion 22 and the heat accumulating portion 24 can be formed using the same material as that used for the heat insulating portion 12 and the heat accumulating portion 14 described above.

In the storage container 1 thus constructed, the heat accumulating portion 14 and the heat accumulating portion 24 are disposed such that their heat accumulating materials are thickened in the direction of thickness thereof at positions (denoted by a symbol α in FIG. 1) where the heat accumulating portions 14 and 24 are adjacent to the packing P with the respective casings of the container body 10 and the door 20 interposed therebetween.

The basic structure of the storage container 1 according to this embodiment is as per described above.

Figure 4:
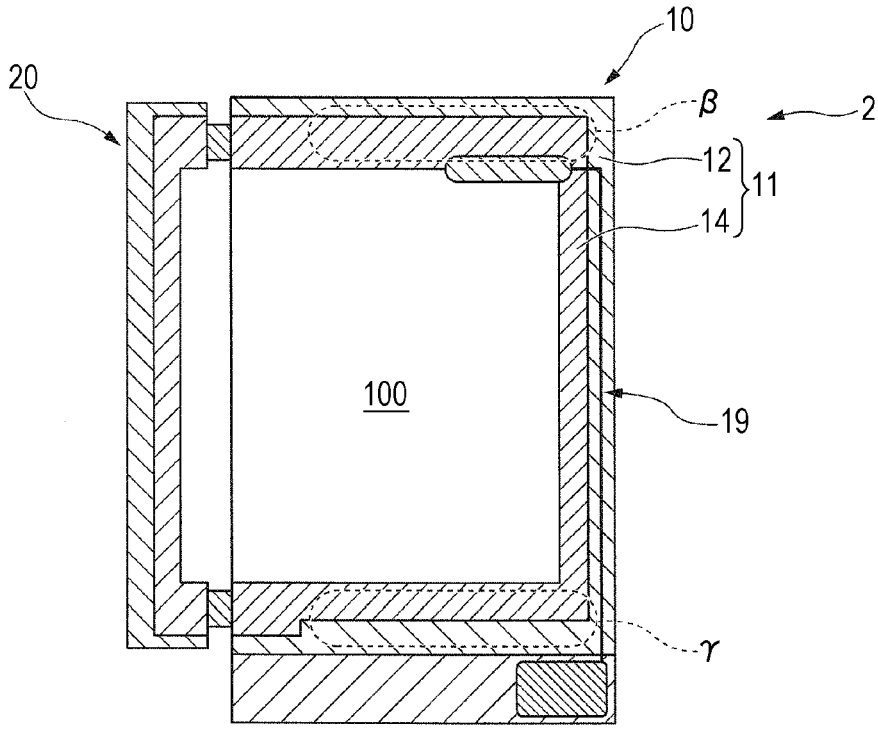
FIG. 4 is an explanatory view illustrating a modification of the storage container according to the first embodiment.
Figure 4:
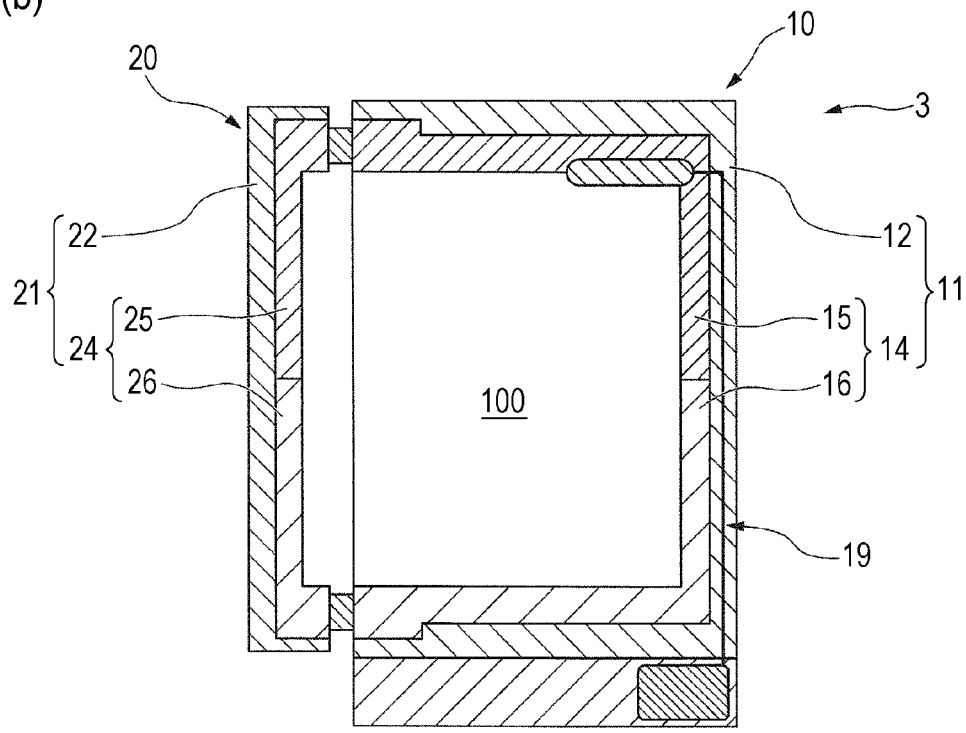

FIG. 4 is an explanatory view illustrating a modification of the storage container according to this embodiment, and it corresponds to FIG. 1(*b*).

The temperature inside the storage room rises with change over time after the operation of the storage container has stopped, whereby a temperature distribution is gradually formed. With the formation of the temperature distribution, relatively warm air resides in an upper portion of the storage room, and relatively cold air resides in a lower portion of the storage room due to change of air density depending on temperature. In other words, a temperature in the upper portion of the storage room is more apt to come closer to the ambient air temperature than that in the lower portion of the storage room. To suppress the formation of the temperature distribution, the modification of the storage container according to this embodiment can be constructed as follows.

In a storage container 2 illustrated in FIG. 4(*a*), the heat accumulating portion 14 disposed inside a portion of the wall member 11, which is positioned above the storage room 100 (to constitute a ceiling portion thereof), has a larger volume than that disposed inside a portion of the wall member 11, which is positioned under the storage room 100 (to constitute a bottom portion thereof). In FIG. 4(*a*), the heat accumulating portion 14 in a region denoted by a symbol β has a larger volume than the heat accumulating portion 14 in a region denoted by a symbol γ.

In a storage container 3 illustrated in FIG. 4(*b*), the heat accumulating portion 14 included in the wall member 11 is made up of an upper heat accumulating portion 15 disposed on the upper side of the storage room 100 and a lower heat accumulating portion 16 disposed on the lower side of the storage room 100. Similarly, the heat accumulating portion 24 included in the wall member 21 of the door 20 is made up of an upper heat accumulating portion 25 disposed on the upper side of the storage room 100 and a lower heat accumulating portion 26 disposed on the lower side of the storage room 100. The upper heat accumulating portion 15 is formed using a material that exhibits a larger amount of latent heat than a material of the lower heat accumulating portion 16. Similarly, the upper heat accumulating portion 25 is formed using a material that exhibits a larger amount of latent heat than a material of the lower heat accumulating portion 26.

With such a feature, cold air is supplied to the upper portion of the storage room 100 for a longer time than to the lower portion of the storage room 100. It is hence possible to cool warm air tending to reside in the upper portion of the storage room, and to reduce a temperature difference between the warm air and cold air residing in the lower portion of the storage room. Accordingly, the formation of the temperature distribution can be suppressed in the storage containers 2 and 3 described above.

The storage container 1 of this embodiment will be described in more detail below with reference to FIGS. 5 to 13, taking thermal characteristics of the heat accumulating portion into account. It is to be noted that the symbols used in FIG. 1 are also used as appropriate in the following description.

First, the heat accumulating material of the heat accumulating portion is discussed.

Figure 5:
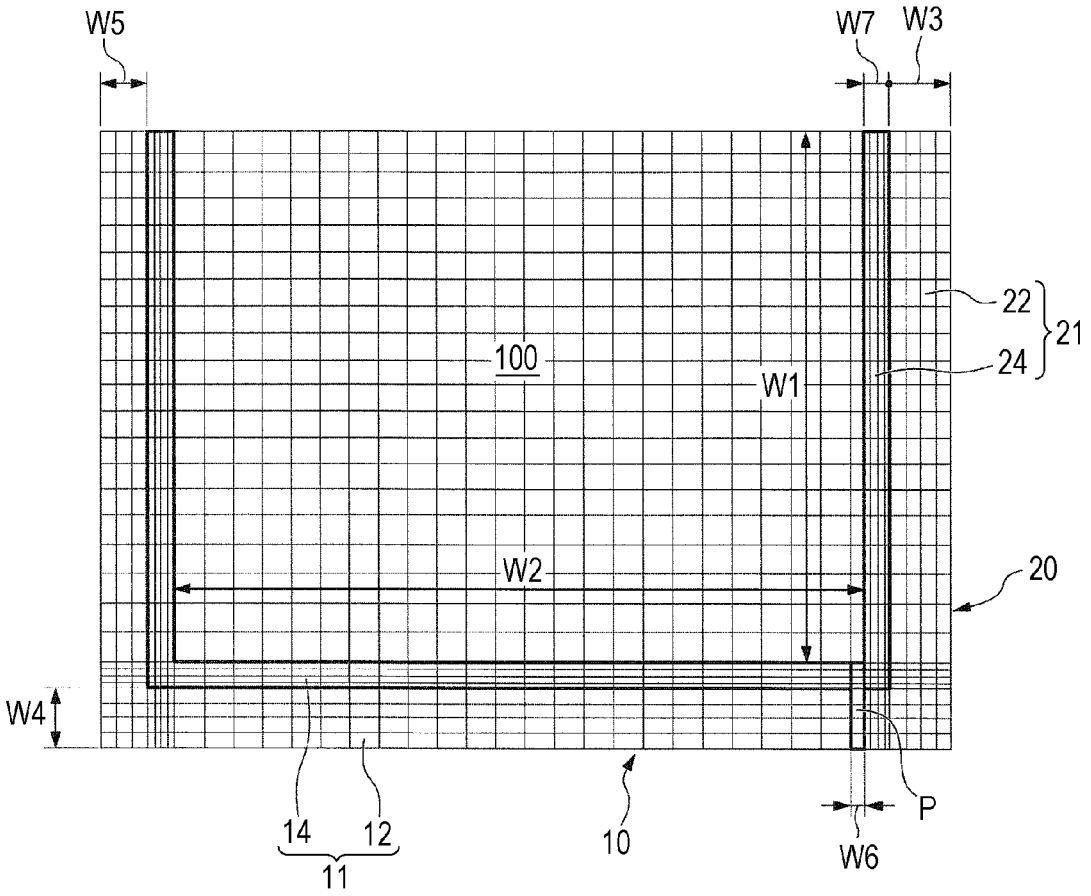
FIG. 5 illustrates a calculation model used for determining a temperature distribution in a section, taken in the horizontal direction, of the storage container.

The thermal characteristics of the heat accumulating portion are determined by simulation using a two-dimensional model illustrated in FIG. 5. FIG. 5 illustrates a calculation model used for determining a temperature distribution in a section, taken in the horizontal direction, of the storage container 1. Here, the storage container 1 is regarded as a substantially rectangular parallelepiped, and calculation is performed on a half region in consideration of symmetry with respect to the above-mentioned section.

In FIG. 5, symbols W1 and W2 denote inner dimensions of the storage room 100, and a symbol W3 denotes a thickness of the heat insulating portion 22 constituting the wall member 21. Symbols W4 and W5 each denote a thickness of the heat insulating portion 12 constituting the wall member 11, a symbol W6 denotes a thickness of the packing P disposed at a contact portion between the container body 10 and the door 20, and a symbol W7 denotes a thickness of each of the heat accumulating portions 14 and 24 constituting the respective wall members. Values of those dimensions and thicknesses are given as W1: 400 mm, W2: 500 mm, W3: 45 mm, W4: 45 mm, W5: 35 mm, and W6: 1 mm, whereas W7 is a variable.

Figure 6:
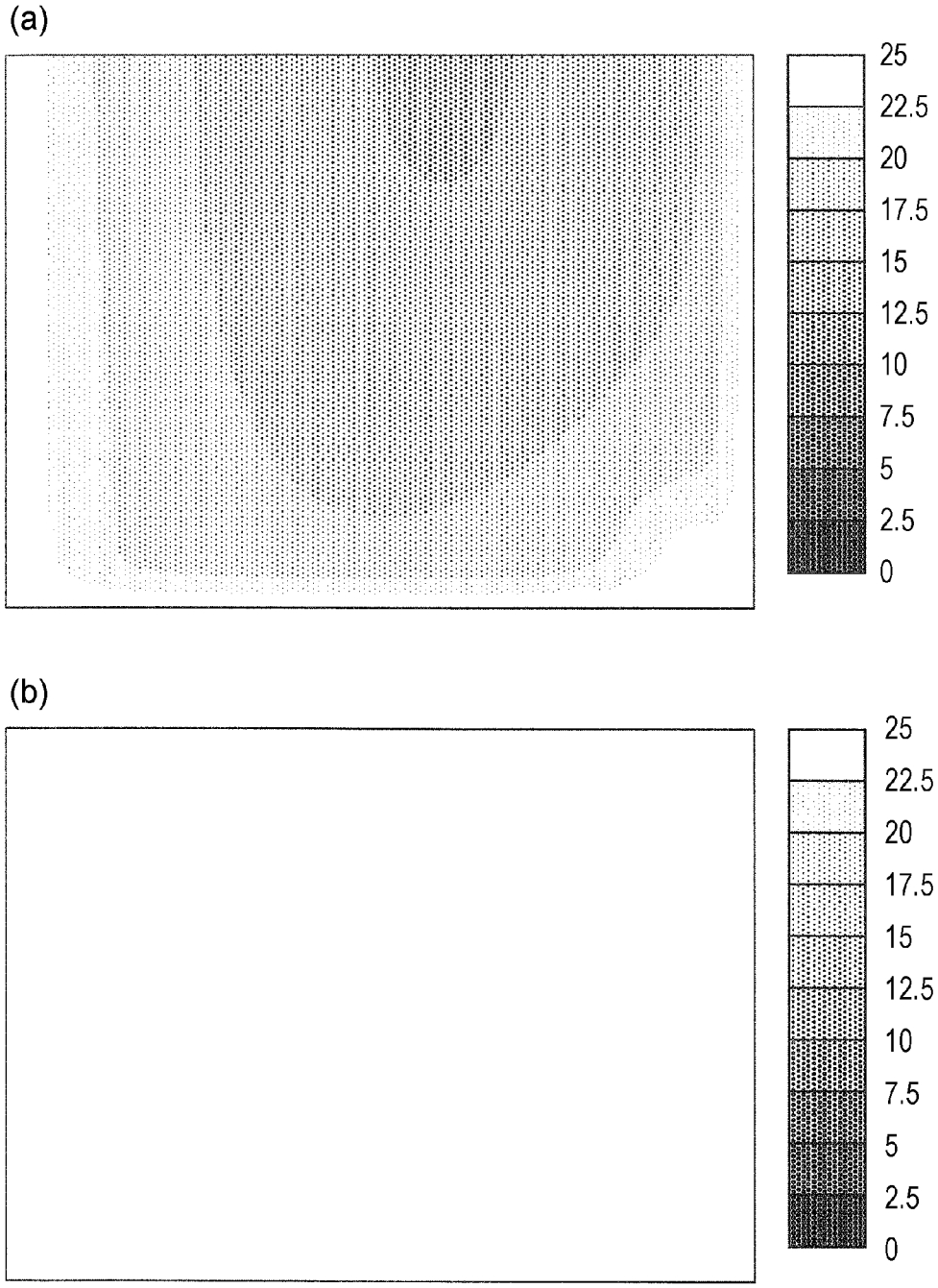
FIG. 6 represents the results of non-stationary heat conduction analyses using the calculation model.
Figure 7:
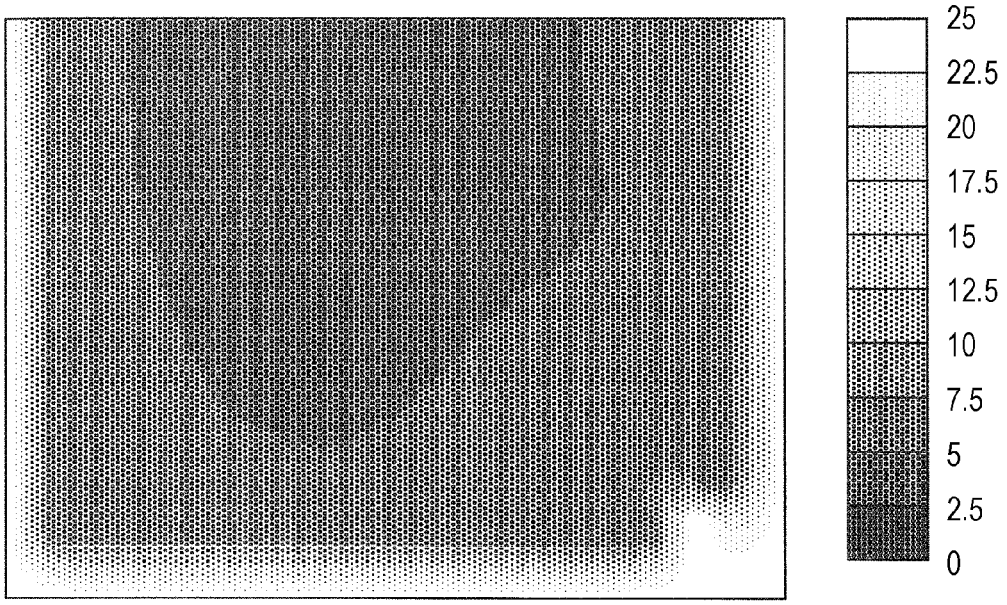
FIG. 7 represents the results of non-stationary heat conduction analyses using the calculation model.
Figure 7:
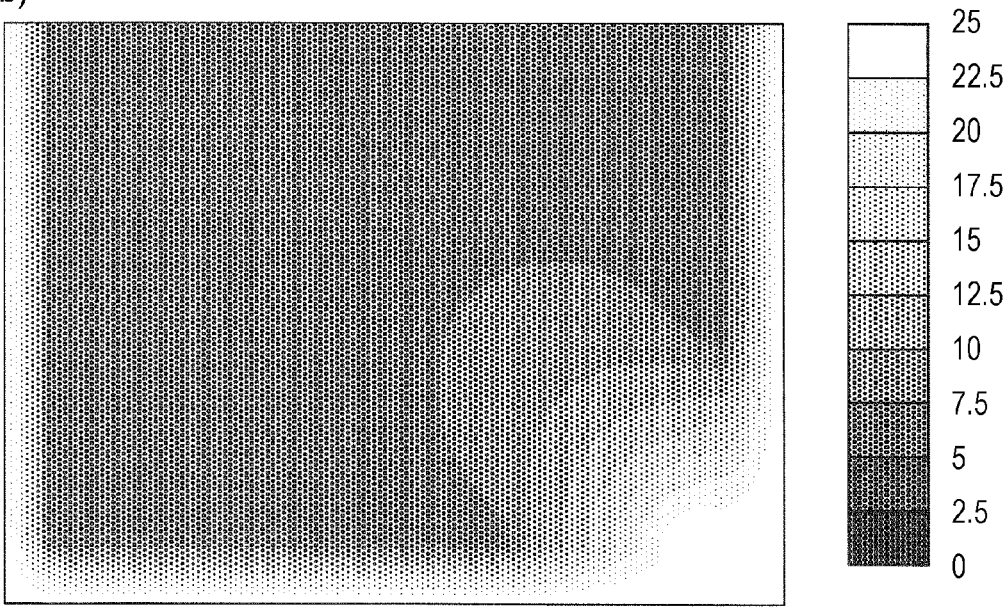

FIGS. 6 and 7 represent the results of non-stationary heat conduction analyses using the calculation model illustrated in FIG. 5. FIG. 6 represents the temperature inside the storage room 100 when the heat accumulating portions 14 and 24 are not disposed (W7=0 mm), and FIG. 7 represents the temperature inside the storage room 100 when the heat accumulating portions 14 and 24 (W7=5 mm), each using paraffin as the heat accumulating material, are disposed. In each of FIGS. 6 and 7, (a) represents the temperature after the lapse of 1 hour, and (b) represents the temperature after the lapse of 12 hours.

Calculation conditions are as follows; melting point (phase transition temperature) of paraffin: 5.9° C., latent heat: 229 kJ/kg, starting temperature: 3° C., ambient air temperature: 25° C., material of the packing P: iron, and filling factor of the heat accumulating material in the heat accumulating portion: 100%.

As seen from FIG. 6, when the heat accumulating portions 14 and 24 are not disposed, the temperature inside the storage room 100 rises to 10 and several ° C. just after 1 hour (FIG. 6(*a*)), and it becomes completely equal to the ambient air temperature after 12 hours (FIG. 6(*b*)). On the other hand, as seen from FIG. 7, when the heat accumulating portions 14 and 24 are disposed, the temperature inside the storage room is maintained at about 5° C. after 1 hour (FIG. 7(*a*)), and it can be substantially held at about 7° C. to 8° C. even after 12 hours (FIG. 7(*b*)).

Moreover, as seen from FIG. 7, inflow of heat into the storage room 100 of the storage container 1 after stop of the operation occurs primarily at a position of the packing P, and heat drifts to the inside of the storage room 100 from the position of the packing P. In view of such a point, performance of the heat accumulating portion 14 is studied by simulation in consideration of a heat drift.

Figure 8:
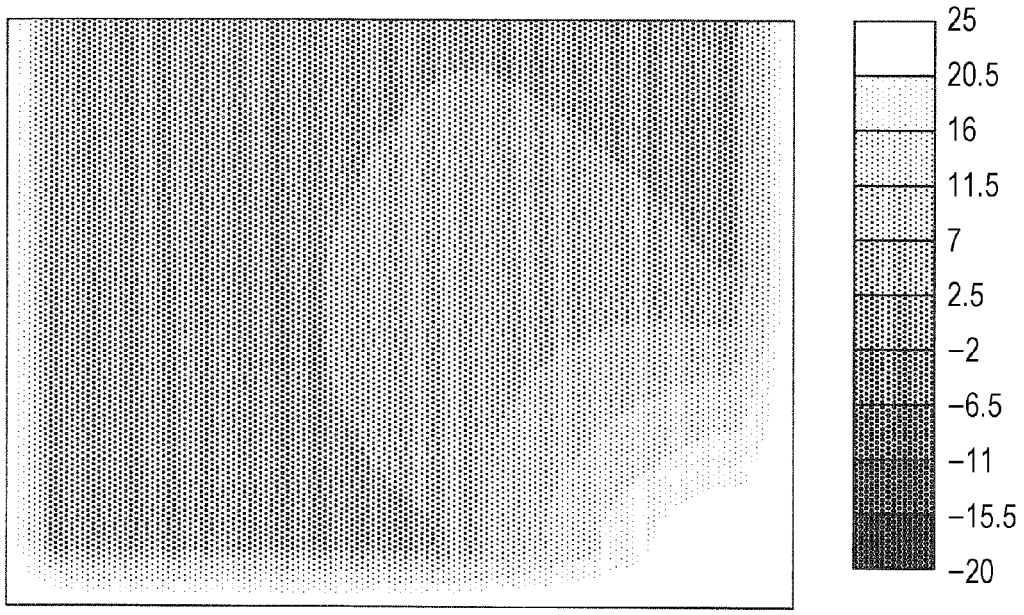
FIG. 8 represents the results of non-stationary heat conduction analyses using the calculation model.
Figure 8:
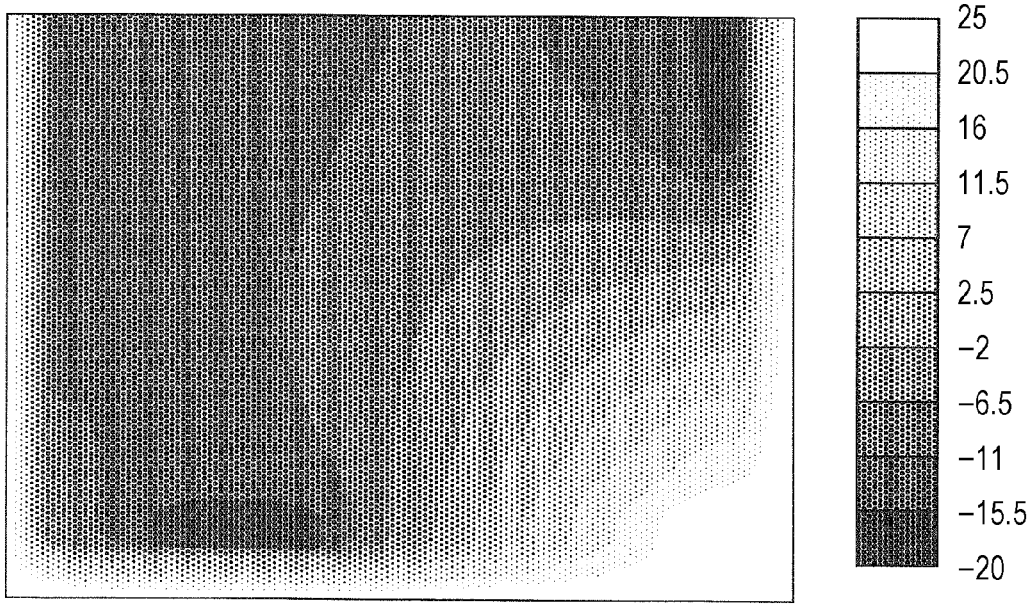

FIG. 8 represents the results of calculations made on models differing only in physical characteristics of the heat accumulating material constituting the heat accumulating portion, and it corresponds to FIGS. 6 and 7. Here, the calculations are performed in assumption of two types of heat accumulating materials, which have the same phase transition temperature, but which are different in value of latent heat and thermal conductivity. The calculation conditions other than the heat accumulating material are the same as those in the cases of FIGS. 6 and 7 except for setting the phase transition temperature: −18° C. and the starting temperature: −18° C.

The heat accumulating material in the case of FIG. 8(*a*) has latent heat: 334 kJ/kg and thermal conductivity: 2.2 W/(m·K), and the heat accumulating material in the case of FIG. 8(*b*) has latent heat: 229 kJ/kg and thermal conductivity: 0.34 W/(m·K). Respective values of the latent heat and the thermal conductivity of the heat accumulating material, which is used in the calculation for the case of FIG. 8(*a*), are comparable to those of ice. Respective values of the latent heat and the thermal conductivity of the heat accumulating material, which is used in the calculation for the case of FIG. 8(*b*), are comparable to those of paraffin.

FIGS. 8(*a*) and 8(*b*) each represent a temperature distribution after 12 hours. As seen from FIGS. 8(*a*) and 8(*b*), a temperature rise is suppressed in FIG. 8(*b*) to a larger extent than in FIG. 8(*a*).

Figure 9:
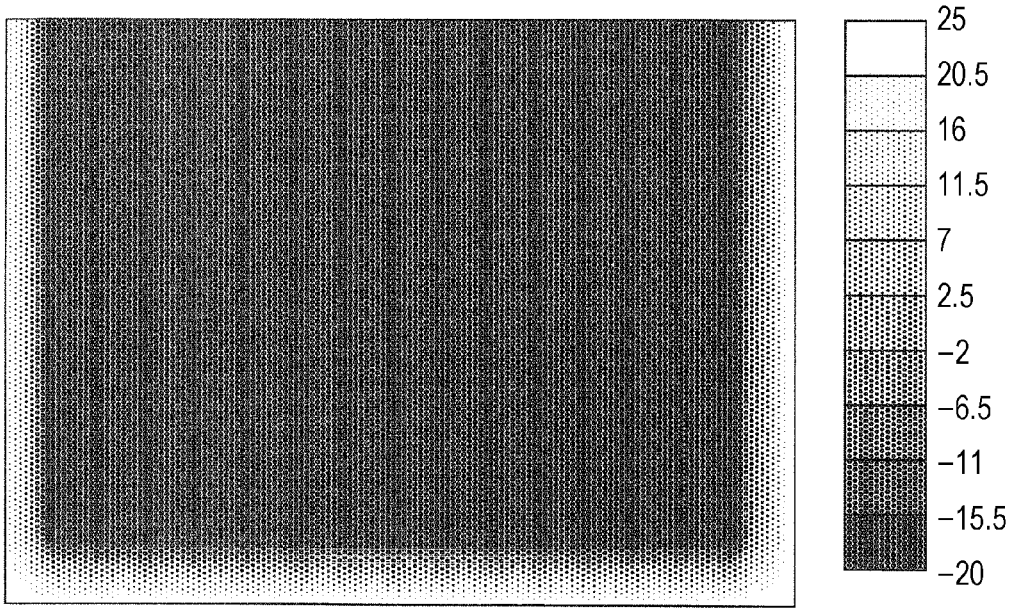
FIG. 9 represents the result of a non-stationary heat conduction analysis using the calculation model.

FIG. 9 represents the result of calculation made on a model without including the packing P, i.e., under the same conditions as those in the case of FIG. 8(*a*) except that the storage room 100 is enclosed by the wall member (including the heat insulating portion and the heat accumulating portion). As seen from FIG. 9, in the model having such a structure, a temperature rise inside the storage room can be suppressed even after 12 hours.

As seen from the calculation results described above, in the structure of the storage container including the packing P, inflow of heat from the position of the packing P is a main factor causing temperature change in the storage room, and selection of the heat accumulating material of the heat accumulating portion disposed near the packing P is inappropriate if the selection is made in consideration of only the value of latent heat. Thus, it is seen that not only the value of latent heat, but also the value of thermal conductivity have to be taken into consideration for selecting the heat accumulating material, which is preferable as a material of the heat accumulating portion.

As a result of conducting studies based on the above-described calculation results, the inventors have found that it is effective to evaluate the material of the heat accumulating portion by employing the temperature conductivity expressed by the following formula (1).

$$\alpha = \frac{k}{\rho \cdot C} \tag{1}$$

($\alpha$: temperature conductivity ($m^2/s$), k: thermal conductivity (W/(m·K)), $\rho$: density of the material of the heat accumulating portion ($kg/m^3$), and C: specific heat of the material of the heat accumulating portion (J/(kg·K))

Here, the specific heat in the above formula is used on an assumption that it is the latent heat in the phase transition temperature zone. The specific heat is equivalent to an amount of heat necessary for raising the temperature of the heat accumulating material by 1° C. Therefore, when the phase transition temperature zone ranges over 2° C., for example, the specific heat used in the above formula 1 can be obtained by dividing a total amount of latent heat by a temperature width of the phase transition temperature zone.

For ice and paraffin, the temperature conductivity is obtained as per indicated in Table 1 given below.

TABLE 1

| Material | Density [kg/m³] | Latent Heat [J/kg · K] | Thermal Conductivity [W/m · K] | Temperature Conductivity [m²/s] |
|---|---|---|---|---|
| Paraffin (n-tetra- decane (m.p. 5.9° C.)) | 790 | 229,000 | 0.34 | $1.88 \times 10^{-9}$ |
| Ice | 990 | 334,000 | 2.2 | $6.65 \times 10^{-9}$ |

Thus, the amount of latent heat of paraffin is smaller than that of ice, while the temperature conductivity of paraffin is smaller than that of ice. In other words, the temperature of paraffin is less apt to rise, and paraffin takes a longer time than ice until completion of the phase transition. As a result, paraffin can maintain the phase transition temperature for a longer time than ice. It is hence understood that, comparing ice and paraffin, paraffin having the lower temperature conductivity exhibits a higher temperature keeping effect when inflow of heat occurs. Stated in another way, comparing ice and paraffin, a higher temperature keeping effect can be obtained by employing paraffin as the material of the heat accumulating portion at a position where inflow of heat occurs, i.e., in a region near the packing P in this embodiment.

The thickness of the heat accumulating portion 14 is discussed below.

In the storage container 1 illustrated in FIG. 1, as described above, the heat accumulating portion 14 and the heat accumulating portion 24 are disposed such that their heat accumulating materials are thickened in the direction of thickness thereof at positions (denoted by a symbol $\alpha$ in FIG. 1) where the heat accumulating portions 14 and 24 are adjacent to the packing P with the respective casings of the container body 10 and the door 20 interposed therebetween. Stated in another way, the heat accumulating portion 14 and the heat accumulating portion 24 at the positions denoted by the symbol $\alpha$ have a smaller index value, which is defined as a value obtained by dividing the temperature conductivity of the material by the amount of the material used per unit area in an inner wall surface of the storage room 100, than the heat accumulating portions at other positions. The reason is as follows.

When the storage container 1 stops the operation, external heat flows into the storage room 100 through mainly the packing P and raises the temperature inside the storage room 100. Such a phenomenon is attributable to the fact that, since the container body 10 and the door 20 are contacted with each other with the packing P interposed therebetween, the heat insulating portions 12 and 22 and the heat accumulating portions 14 and 24 of the storage container 1 are discontinuous at the packing. It can be thus said that, in the storage room 100, the vicinity of the packing P is an area (first area AR1) where a temperature is more apt to come closer to the ambient air temperature than an area (second area AR2) away from the packing P.

Taking the above-mentioned point into account, in the storage container 1 of this embodiment, instead of uniformly arranging the heat accumulating portion 14, the heat accumulating portion 14 is disposed to have a larger thickness (smaller index value) in the wall member 11 in the vicinity of the packing P, i.e., in a portion where a temperature is more apt to come closer to the ambient air temperature after stop of the operation, than in a portion where a temperature is less apt to come closer to the ambient air temperature. As a result, a temperature is harder to rise in the vicinity of the packing P than at the position away from the packing P, whereby cold air is supplied for a longer time in the vicinity of the packing P. Hence, even when the operation is stopped, the temperature inside the storage room can be more easily maintained for a certain time not to cause a temperature distribution.

The index value may be controlled by employing, as the material of the heat accumulating portions 14 and 24 disposed near the first area AR1, a material having smaller temperature conductivity at the phase transition temperature than the material of the heat accumulating portions 14 and 24 disposed near the second area AR2.

As an alternative method, the index value may be controlled by disposing the material of the heat accumulating portions 14 and 24 disposed near the first area AR1 to have a larger total amount of latent heat than the material of the heat accumulating portions 14 and 24 disposed near the second area AR2. In the above formula (1) expressing the temperature conductivity, the denominator contains a term of specific heat, i.e., latent heat in the phase transition temperature zone. Furthermore, the denominator of a formula expressing the above-mentioned index value contains a term of the product of specific heat and the amount of the material used, i.e., the total amount of latent heat. Accordingly, as the total amount of latent heat increases, the index value reduces. This implies that the alternative method also satisfies the above-described concept.

Although an area where a temperature is more apt to come closer to the ambient air temperature is expressed by the first area and an area where a temperature is less apt to come closer to the ambient air temperature is expressed by the second area in the above description, those expressions represent a relative positional relation and it does not necessarily implies that an entire space of the storage container is separated into only two areas. For example, when there is an area where the thickness of the heat insulating material is relatively thin, such an area has lower heat insulation performance. Therefore, a temperature in that area is more apt to come closer to the ambient air temperature than other portions, but it is less apt to come closer to the ambient air temperature than the packing portion. Even when there are three or more areas exhibiting different levels of heat insulation performance like the above-mentioned example, two among those three or more areas are expressed as the first area and the second area based on comparison between them.

Here, as the thickness of the heat accumulating portion 14 increases, i.e., as the amount of latent heat accumulated in the heat accumulating portion 14 increases, the above-mentioned index value reduces and a time during which cold air can be released prolongs. Hence a temperature rise in the storage room 100 after stop of the operation can be suppressed for a longer time. On the other hand, if the heat accumulating portion 14 is too thick, an adverse effect would be caused on the production cost and the shape and the size of a product.

Accordingly, the thickness of the heat accumulating portion 14 is preferably set to a value satisfying such a requirement that the temperature inside the storage room 100 does not reach, e.g., an maximum temperature allowed as the storage room temperature (i.e., allowable temperature) even after the lapse of a preset time (temperature retainable time) after stop of the operation.

The temperature retainable time is calculated and set on an assumption that there is no thermal load inside the storage room 100 except for components thereof, i.e., that the storage room 100 contains no special thermal source acting to raise the temperature inside the storage room after stop of the operation.

In consideration of the above-discussed inflow and transfer of heat, the thickness of the heat accumulating portion 14 can be determined as follows.

For simplification of the calculation, composite thermal conductivity is first determined from a formula expressing heat flux passing through the heat insulating portion 12 and the heat accumulating portion 14 on condition that the thickness of the wall member 11 is equal to the thickness of the heat accumulating portion 14.

Figure 10:
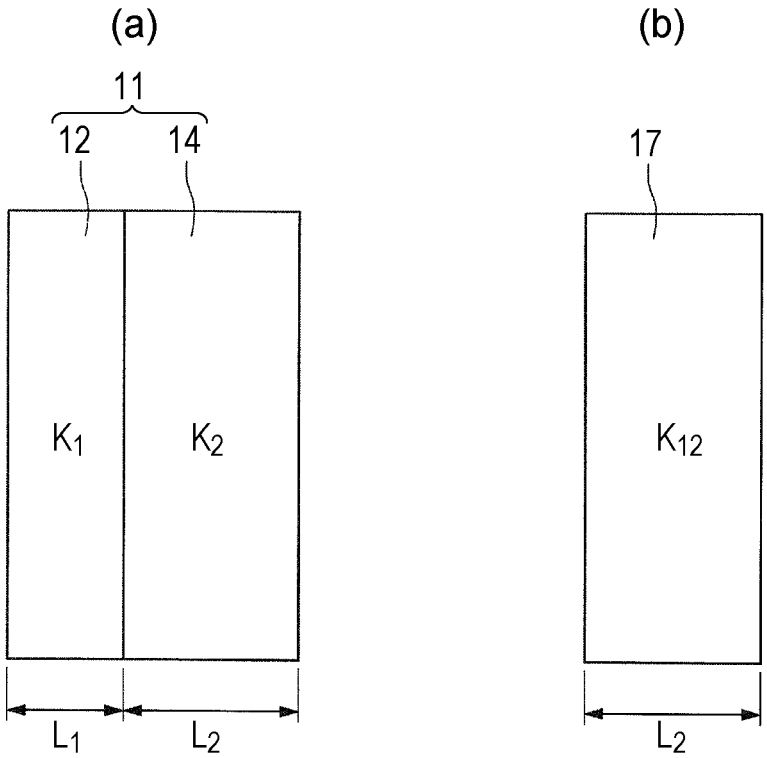
FIG. 10 is an explanatory view illustrating a calculation model.

In more detail, the calculation is simplified by replacing a calculation model in which the wall member 11 is made up of the heat insulating portion 12 having a thickness $L_1$ and thermal conductivity $k_1$ and the heat accumulating portion 14 having a thickness $L_2$ and thermal conductivity $k_2$, as illustrated in FIG. 10(*a*), with a calculation model using a wall member 17 that is made up of an imaginary material having a thickness $L_2$ and thermal conductivity $k_{12}$, as illustrated in FIG. 10(*b*). The thermal conductivity of the wall member 17 is then determined.

When a predetermined amount of heat flows into the storage room 100 from the outside, the amount of heat is expressed by the following formula (2) for the calculation model illustrated in FIG. 10(*a*), and by the following formula (3) for the calculation model illustrated in FIG. 10(*b*). From the formulae (2) and (3), therefore, the thermal conductivity of the wall member 17 illustrated in FIG. 10(*b*), i.e., the composite thermal conductivity of the heat insulating portion 12 and the heat accumulating portion 14, is determined as per the following formula (4).

$$q = \frac{T_1 - T_2}{\left(\frac{L_1}{k_1} + \frac{L_2}{k_2}\right)} \tag{2}$$

$$q = \frac{k_{12}(T_1 - T_2)}{L_2} \tag{3}$$

$$k_{12} = \frac{L_2}{\left(\frac{L_1}{k_1} + \frac{L_2}{k_2}\right)} \tag{4}$$

(q: amount of heat (W), $T_1$: ambient air temperature (K), $T_2$: setting temperature of the storage room (K), $L_1$: thickness of the heat insulating portion (m), $L_2$: thickness of the heat accumulating portion (m), $k_1$: thermal conductivity of the heat insulating portion (W/(m·K)), $k_2$: thermal conductivity of the heat accumulating portion (W/(m·K)), and $k_{12}$: composite thermal conductivity of the heat insulating portion and the heat accumulating portion (W/(m·K))

Figure 11:
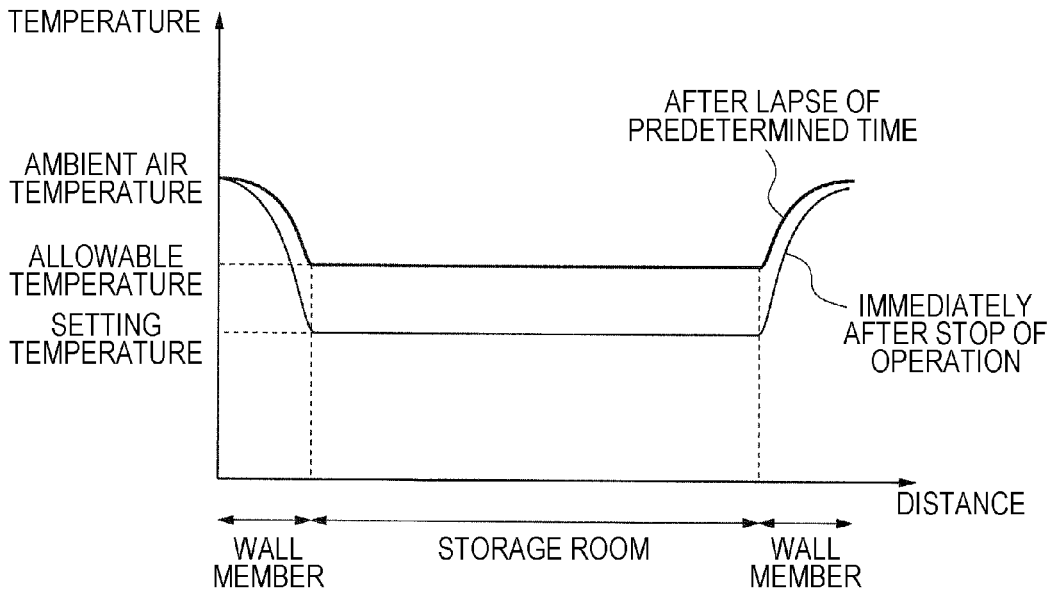
FIG. 11 is a graph depicting the relation of a temperature with respect to a distance measured in a direction toward the inside of the storage container.
Figure 11:
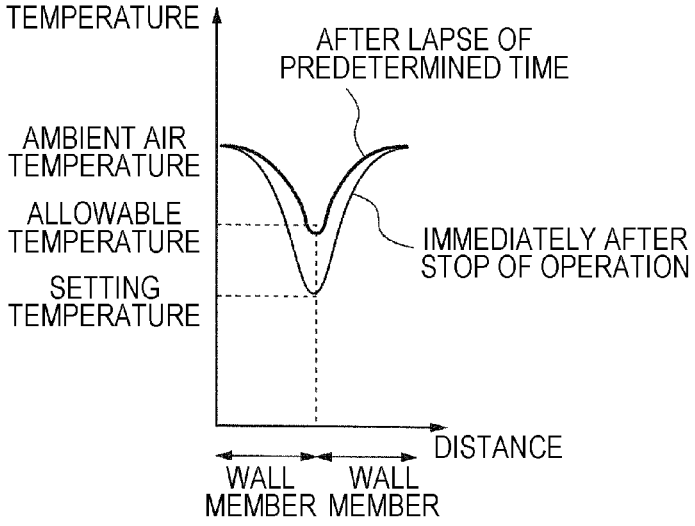

The structure of the storage container 1 is simplified and inflow of heat into the simplified structure is discussed below. FIG. 11 is a graph depicting the relation of a temperature with respect to a distance measured in a direction toward the inside of the storage container from an outer surface of the storage container.

As illustrated in FIG. 11(*a*), because heat outside the storage container is conducted to the inside of the storage room through the wall member, the temperature of the wall member is equal to the ambient air temperature at the outer surface of the storage room, is equal to the temperature inside the storage room at an inner surface thereof, and is changed in the direction of thickness of the wall member. Furthermore, because thermal capacity of air in the storage room is small, the temperature of air in the storage room can be assumed to be the same as that of an inner wall of the storage room. Such a temperature profile is similar not only immediately after stop of the operation, but also at the time when the temperature inside the storage room reaches the allowable temperature after the lapse of a predetermined time.

Therefore, on an assumption that temperature change in the storage room can be determined by calculating temperature change of the inner wall of the storage room, the temperature inside the storage room is indirectly determined by executing calculation on a calculation model in which the space of the storage room is disregarded as illustrated in FIG. 11(*b*). In the illustrated example, the thickness of the wall member is denoted by $L_2$. Accordingly, in the model illustrated in FIG. 11(*b*), the temperature inside the storage room can be determined by calculating a temperature distribution in a solid body having a thickness of $2L_2$, and further calculating a temperature at a center of the solid body (i.e., a position at a distance $L_2$ from a surface of the solid body).

Figure 12:
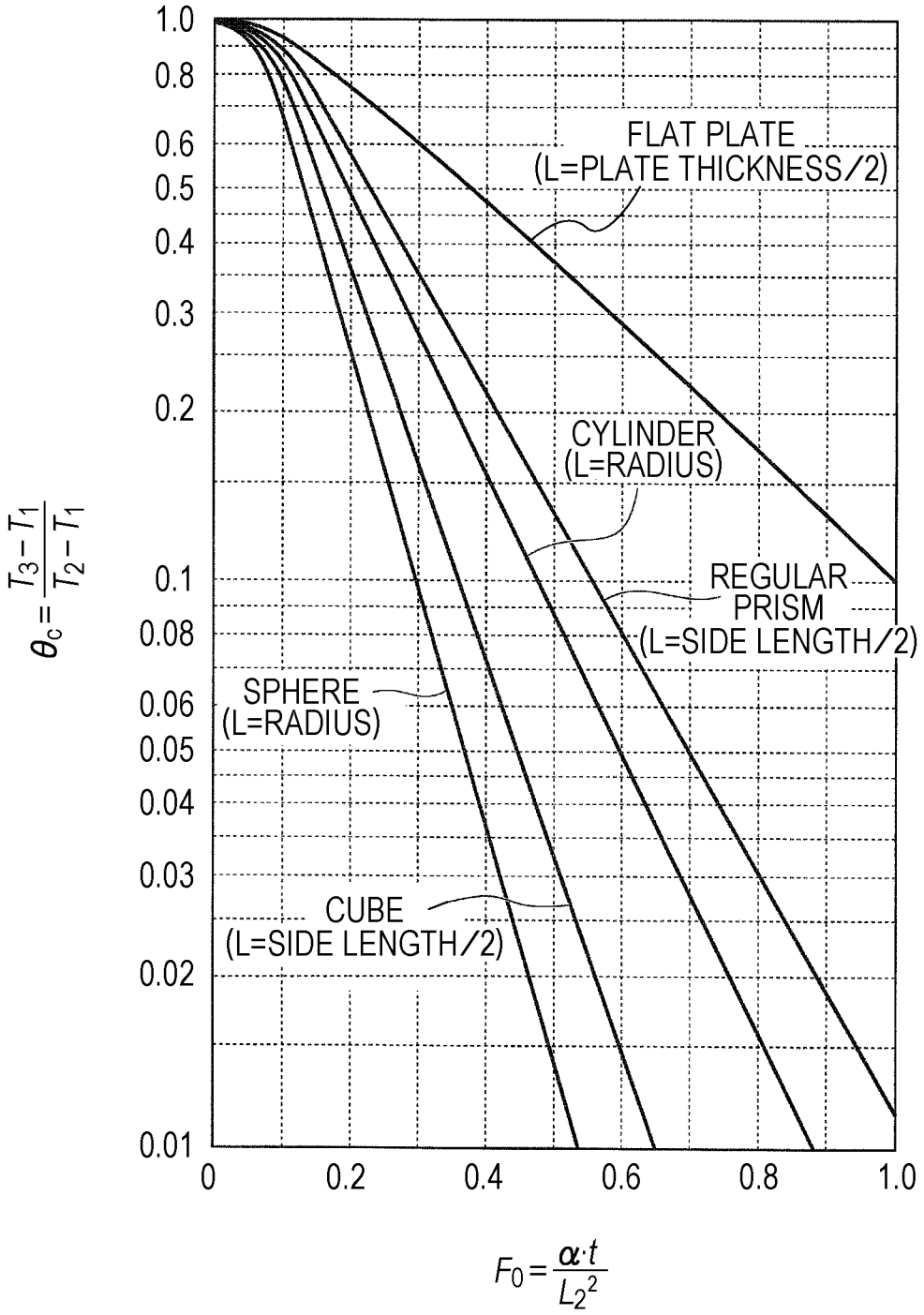
FIG. 12 represents the Heisler chart depicting heat transfer in solid bodies.

Heat transfer from the surface of the above-mentioned solid body (i.e., the storage container from which the storage room is eliminated) to the inside thereof can be calculated by employing an initial temperature of the solid body and an outside temperature, and by solving a basic formula for non-stationary heat conduction, which is used in general heat transfer calculation. For temperature change due to heat transfer toward a center of a solid body, the Heisler chart is known which depicts the heat transfer based on the relation between dimensionless temperature and dimensionless time (Fourier number) as illustrated in FIG. 12. The temperature change inside the solid body can be determined using the Heisler chart.

The dimensionless time (Fourier number) represented by the horizontal axis of the Heisler chart, illustrated in FIG. 12, can be expressed by the following formula (5) using the temperature conductivity of the solid body, the lapsed time after stop of the operation, and the thickness up to the center of the solid body (i.e., the thickness of the wall member).

$$F_0 = \frac{\alpha \cdot t}{L_2^2} \tag{5}$$

($F_0$: dimensionless time (Fourier number), α: temperature conductivity ($m^2/s$), t: lapsed time (s), and $L_2$: thickness of the wall member (m))

The dimensionless temperature represented by the vertical axis of the Heisler chart, illustrated in FIG. 12, can be expressed by the following formula (6) using the ambient air temperature, the setting temperature of the storage room, and the temperature inside the storage room, which changes after stop of the operation.

$$\theta_c = \frac{T_3 - T_1}{T_2 - T_1} \tag{6}$$

($\theta_c$: dimensionless temperature, $T_1$: ambient air temperature (K), $T_2$: setting temperature of the storage room (K), and $T_3$: temperature inside the storage room (K))

Because the ambient air temperature $T_1$ and the setting temperature $T_2$ among the variables representing the dimensionless temperature are setting values, the corresponding Fourier number can be determined by setting the allowable temperature of the storage room 100. The Fourier number may be determined from the Heisler chart, illustrated in FIG. 12, by directly reading it from FIG. 12, or by calculating it based on the following approximate formula (7). The approximate formula (7) expresses a graph related to a flat plate in FIG. 12.

$$\theta_C = 1.273 \cdot \exp(-2.467 \cdot F_0) \tag{7}$$

Among the variables representing the Fourier number expressed by the above formula (5), the temperature conductivity can be calculated using the above formulae (1) and (4). Therefore, a function representing the relation between the thickness of the wall member (i.e., the thickness of the heat accumulating portion) and the lapsed time after stop of the operation can be determined using the Fourier number, obtained from the Heisler chart, and the formula (5).

Figure 13:
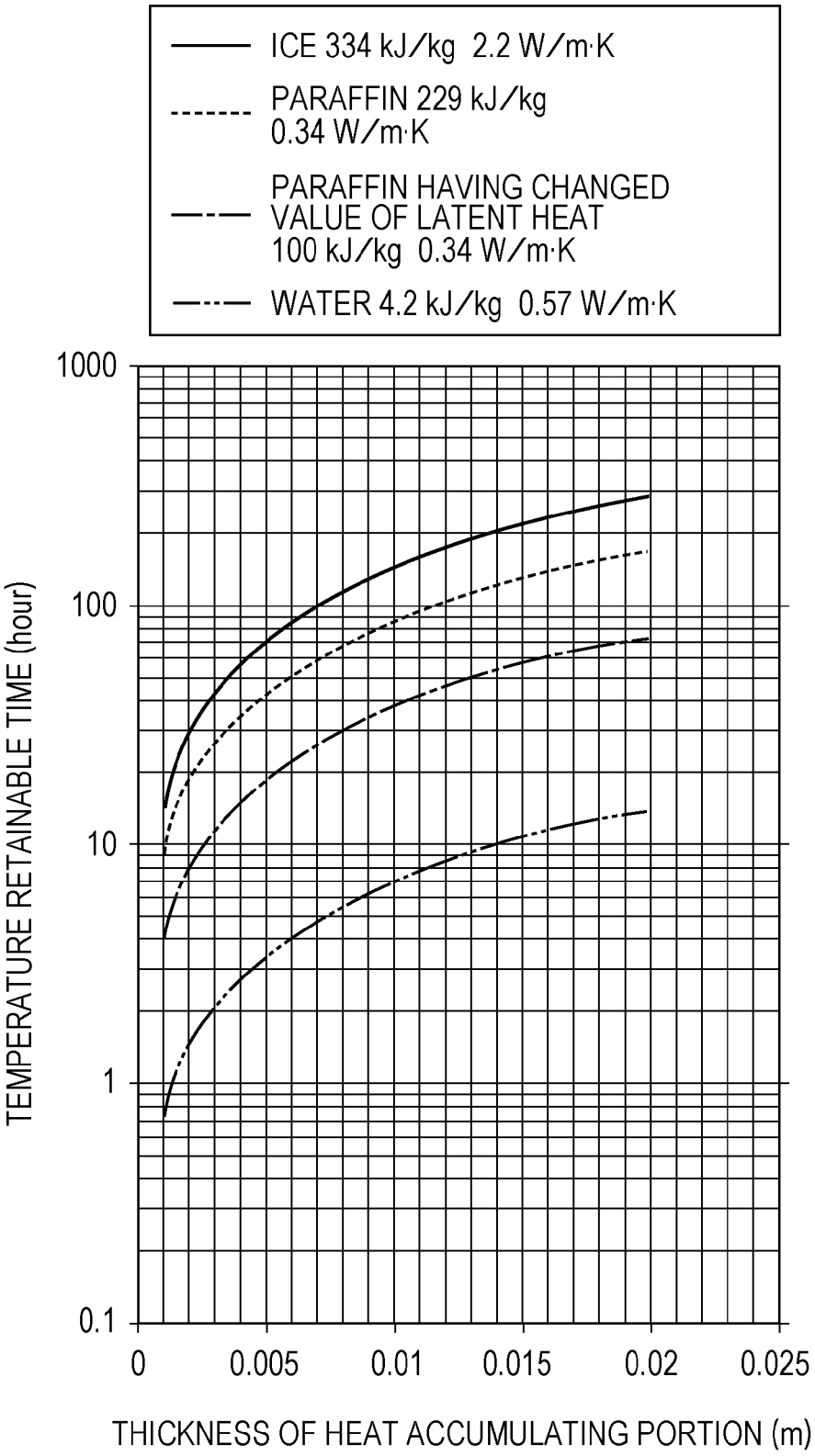
FIG. 13 is a graph depicting the relation of a temperature retainable time with respect to a thickness of the heat accumulating portion.

FIG. 13 is a graph depicting the relation, obtained on the basis of the above-mentioned concept, between the thickness of the heat accumulating portion and the temperature retainable time (i.e., the lapsed time after stop of the operation). FIG. 13 indicates the results of calculating that relation for plural types of heat accumulating materials.

The temperature retainable time is mostly occupied by a time from start of phase change in the heat accumulating material of the heat accumulating portion to end of the phase change. In FIG. 13, therefore, the temperature retainable time is calculated with respect to the thickness of the heat accumulating portion for the case where the temperature inside the storage room changes from 5° C. to 7° C. on condition that the phase transition temperature zone of paraffin is 5° C. to 7° C. and the ambient air temperature is 25° C. Regarding ice, the temperature retainable time is calculated for the case where the temperature inside the storage room changes from 0° C. to 7° C.

Based on the relation of FIG. 13, a required thickness of the heat accumulating portion can be determined, for example, by setting the time until reaching the allowable temperature after stop of the operation. Hence the storage container having the desired specifications can be obtained. Moreover, a time during which a temperature rises up to the allowable temperature after a certain storage container has stopped the operation, i.e., a temperature retainable time in the relevant storage container, can be estimated by employing the relation of FIG. 13.

The temperature retainable time is preferably set to 2 hours as a time that is least necessary for dealing with a power failure. Although the temperature retainable time is prolonged as the thickness of the heat accumulating portion increases, the larger thickness of the heat accumulating portion reduces the volume of the storage room 100. Thus, an upper limit of the temperature retainable time is preferably set to 24 hours from the viewpoint of ensuring a sufficient volume of the storage room 100.

Thus, the storage container having the desired specifications can be obtained by setting the arrangement, the material, and the thickness of the heat accumulating portion as described above.

To prove the effect of the heat accumulating portion disposed in accordance with the above-described concept, the inventors have executed simulation on thermal characteristics of the heat accumulating portion. Calculation models used here are as per illustrated in FIGS. 5 and 14.

Figure 14:
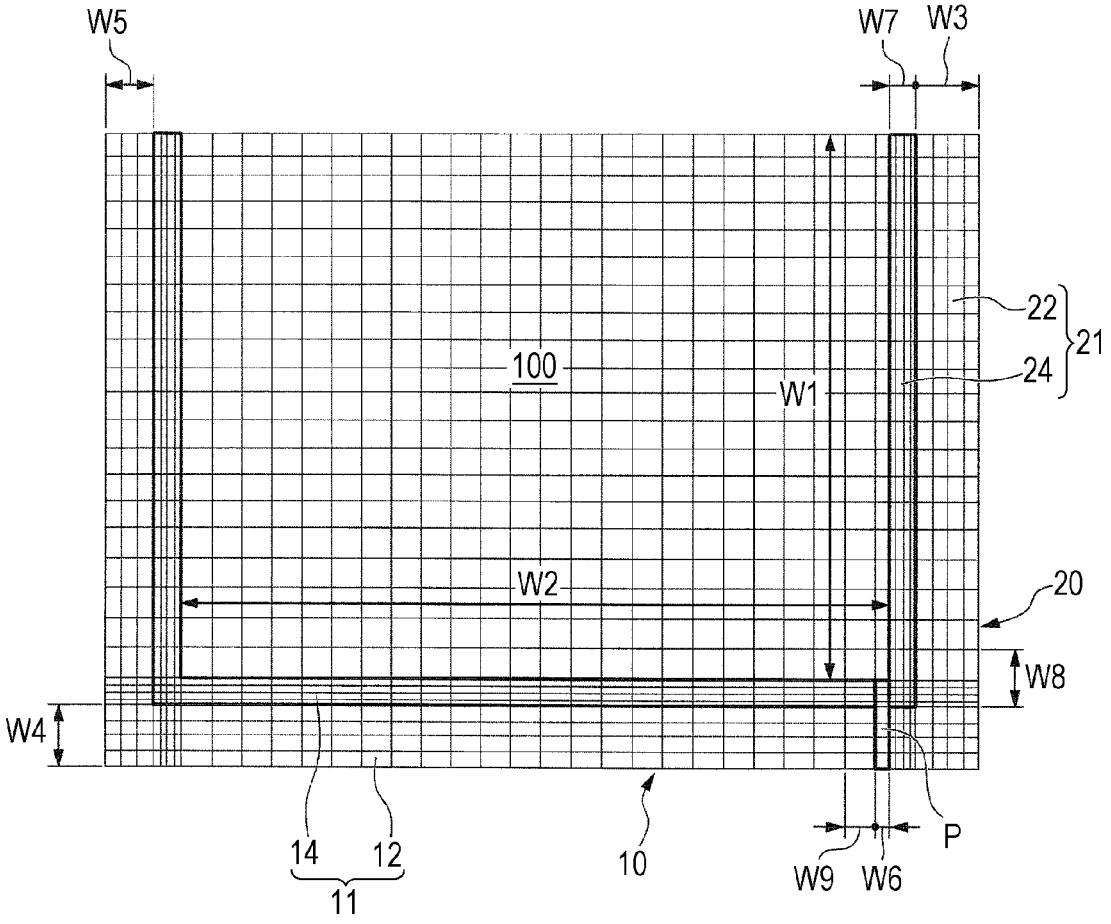
FIG. 14 illustrates a calculation model used for determining a temperature distribution in a section, taken in the horizontal direction, of the storage container.

FIG. 14 corresponds to the calculation model of FIG. 5 and additionally includes parameters W8 and W9. W8 and W9 each denote a length from an end of the heat accumulating portion in its part contacting with the packing P. Table2, given below, lists the parameters used in the calculation.

TABLE 2

| Material | State | Density [kg/m³] | Specific Heat [J/kg · K] | Thermal Conductivity [W/m · K] | Temperature zone |
|---|---|---|---|---|---|
| Urethane Foam | solid | 28.6 | 1900 | 0.019 | — |
| Packing Magnet (iron) | solid | 7870 | 442 | 80.3 | — |
| Air | gas | 1.1763 | 1000 | 0.02614 | — |
| Paraffin | solid | 790 | 1800 | 0.34 | 5° C.> |
| (n-tetra-decane | solid → liquid | 790 | 114500 | 0.34 | 5° C.-7° C. |
| (m.p. 5.9° C.)) | liquid | 790 | 2100 | 0.14 | 7° C.< |

Figure 15:
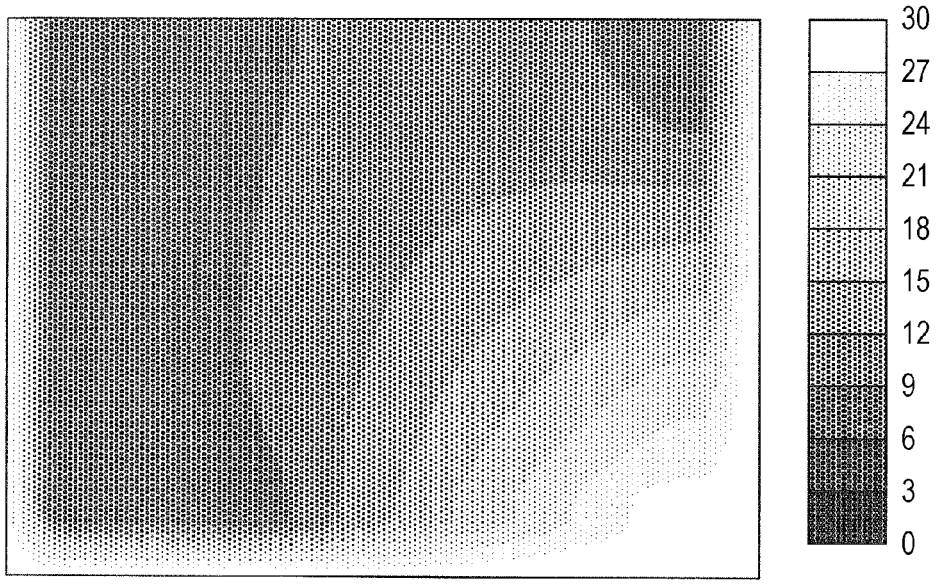
FIG. 15 represents the results of non-stationary heat conduction analyses using the calculation model.
Figure 15:
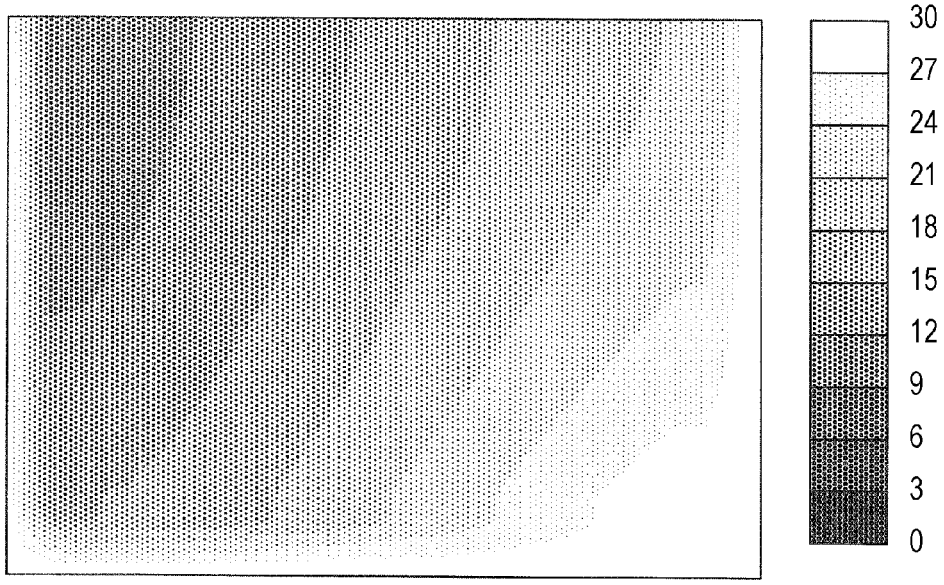

FIGS. 15(*a*) and 15(*b*) represent the calculation results of non-stationary heat conduction analyses using the calculation model illustrated in FIG. 5. Values of symbols W1 to W7 are the same as those in the case of FIG. 7 (W7=5 mm).

Figure 16:
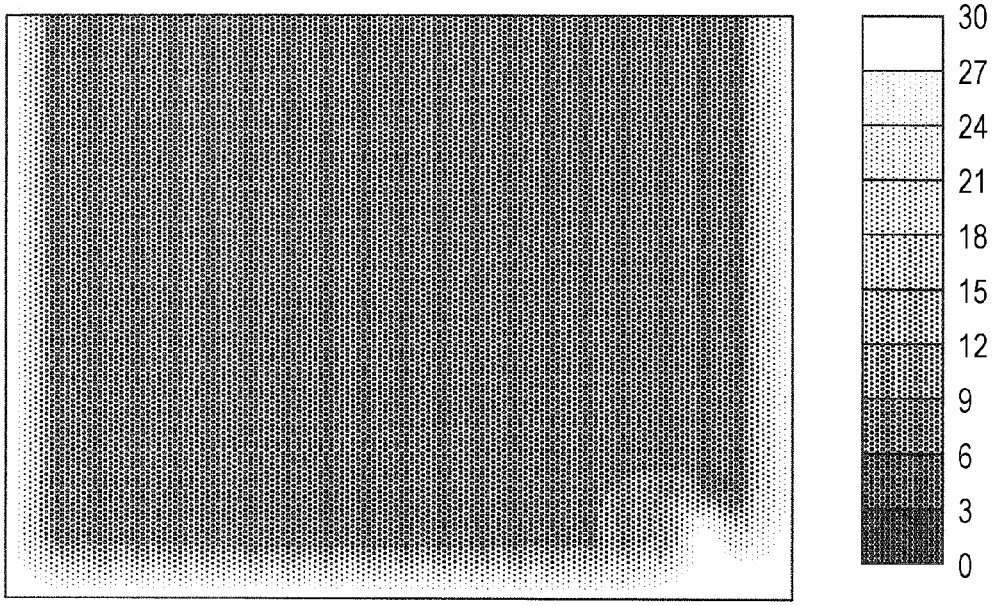
FIG. 16 represents the results of non-stationary heat conduction analyses using another calculation model.
Figure 16:
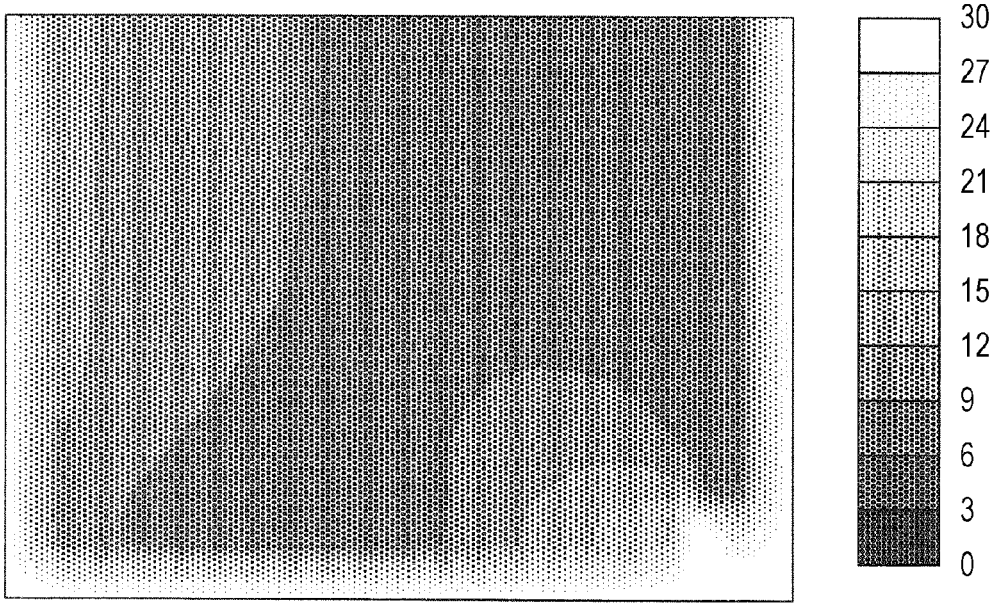

FIGS. 16(*a*) and 16(*b*) represent the calculation results of non-stationary heat conduction analyses using the calculation model illustrated in FIG. 14. Values of symbols W1 to W6 are the same as those in the case of FIG. 14. The thicknesses of the heat accumulating portions 14 and 24 are set to be W7=20 mm in regions of W8=40 mm and W9=20 mm from the respective ends of the heat accumulating portions 14 and 24, and to be W7=2 mm in other regions.

FIGS. 15(*a*) and 16(*a*) represent the temperatures after the lapse of 6 hours, and FIGS. 15(*b*) and 17(*b*) represent the temperatures after the lapse of 8 hours.

Calculation conditions are as follows. Namely, the melting point (phase transition temperature) of paraffin: 5.9° C., latent heat: 229 kJ/kg, starting temperature: 3° C., ambient air temperature: 25° C., material of the packing P: iron, and filling factor of the heat accumulating material in the heat accumulating portion: 100%.

As seen from FIG. 15, the calculation results show that, when the heat accumulating portion 14 is formed in a uniform thickness, a temperature distribution is already formed inside the storage room 100 after the lapse of 6 hours (see FIG. 15(*a*)), and the temperature inside the storage room 100 rises up to near 20° C. after the lapse of 8 hours (see FIG. 15(*b*)). In contrast, as seen from FIG. 16, when the heat accumulating portion 14 is formed in such a distribution that it is thicker in a region around the packing P and thinner in other regions, the temperature inside the storage room is maintained at a level of several ° C. after the lapse of 6 hours (see FIG. 16(*a*)), and it can be held at about 10° C. even after the lapse of 8 hours (see FIG. 16(*b*)).

Taking, as a model, a commercially available product (model number: SJ-V200T) in which the volume of the storage room 100 is 170 L, the amount of the heat accumulating material used in the heat accumulating portion 14 is approximately calculated to be 7 kg in the case of the model corresponding to FIGS. 15(*a*) and 15(*b*). In contrast, the amount of the heat accumulating material used in the heat accumulating portion 14 is 3.3 kg in the case of the model corresponding to FIGS. 16(*a*) and 16(*b*). Accordingly, it is proved that the model corresponding to FIG. 16 can not only keep the temperature inside the storage room 100 for a longer time, but also reduce the amount of the heat accumulating material used.

In other words, it is understood that the storage container capable of effectively keeping the temperature can be obtained by properly setting the arrangement, the material, and the thickness of the heat accumulating portion.

With the storage container 1 constructed as described above, the temperature inside the storage room can be maintained not to cause a temperature distribution for a certain time even if the operation is stopped.

While the above embodiment has been described in connection with the storage container for storing the preserved goods at a lower temperature than the ambient air temperature, another embodiment of the present invention may be constituted as a storage container for storing the preserved goods at a higher temperature than the ambient air temperature, i.e., as the so-called heating cabinet.

In such a case, in a storage room after stop of the operation, the temperature inside the storage room is more apt to come closer to the ambient air temperature in a lower portion of the storage room than in an upper portion of the storage room. Unlike the structure illustrated in FIG. 4, therefore, the heat accumulating portion positioned on the lower side of the storage room is formed to be thicker than the heat accumulating portion positioned on the upper side thereof.

When the storage container is a heating cabinet, the phase transition temperature zone of the heat accumulating material is preferably 80° C. to 100° C. for the reason that the setting temperature of the storage room is usually 80° C. to 100° C. The heat accumulating material used in that case may be, for example, D-Threitol having a phase transition temperature of 90° C. and a value of latent heat of 225 kJ/kg.

While, in the above embodiment, the simulation is executed using the two-dimensional model having a simplified structure for simplification of the calculation, the simulation may be executed using a two-dimensional model reproducing an actual structure of the storage container without simplifying the structure.

While the above embodiment has been described in connection with the storage container including only one storage room 100, the storage container may include two or more storage rooms having different setting temperatures, for example. In such a case, the heat accumulating portion is set corresponding to each of the storage rooms.

While, in the above embodiment, the door 20 is rotatably attached to the container body 10, a manner of attaching the door 20 is not limited to the illustrated one insofar as the door (lid) is attached in a state capable of opening and closing the storage room 100.

For example, the storage room 100 may be opened and closed with a lid sliding over predetermined rails. Alternatively, the lid may be detachably attached such that the storage room 100 can be opened and closed. Even in any of those constructions, there also exists such a situation that a space near the lid is an area where a temperature is more apt to come closer to the ambient air temperature after stop of the operation. Therefore, a storage container capable of keeping cold for a longer time even after stop of the operation can be obtained by thickening the heat accumulating portion that is disposed in the wall member near the lid.

[Second Embodiment]

Figure 17:
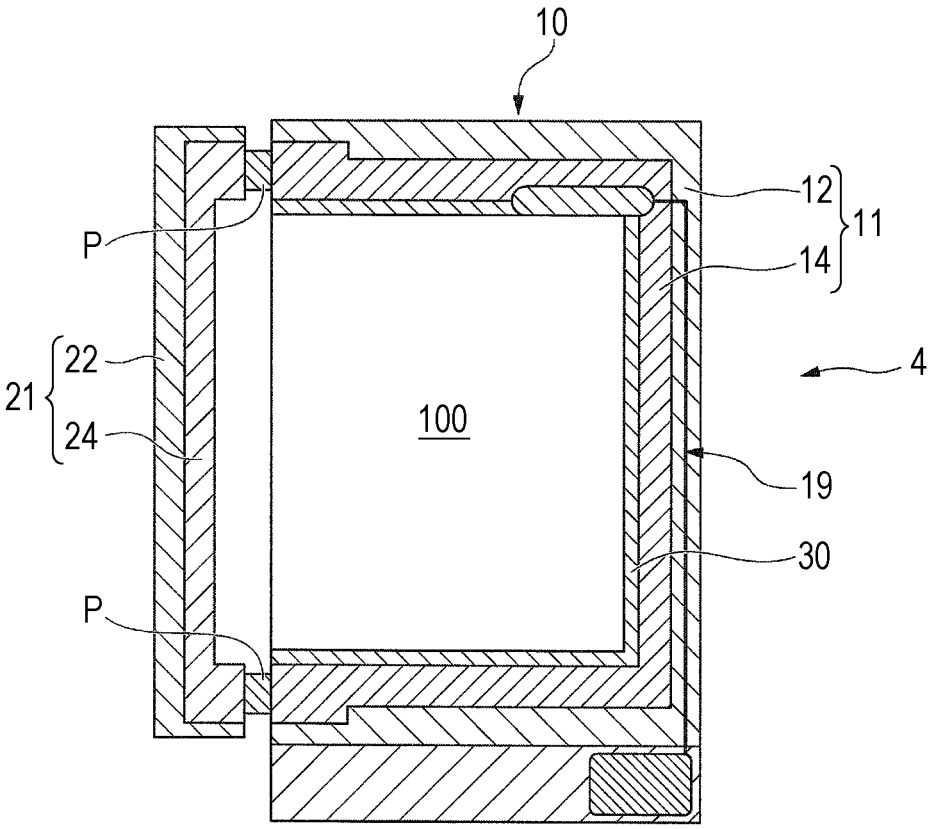
FIG. 17 is an explanatory view illustrating a storage container according to a second embodiment.
Figure 18:
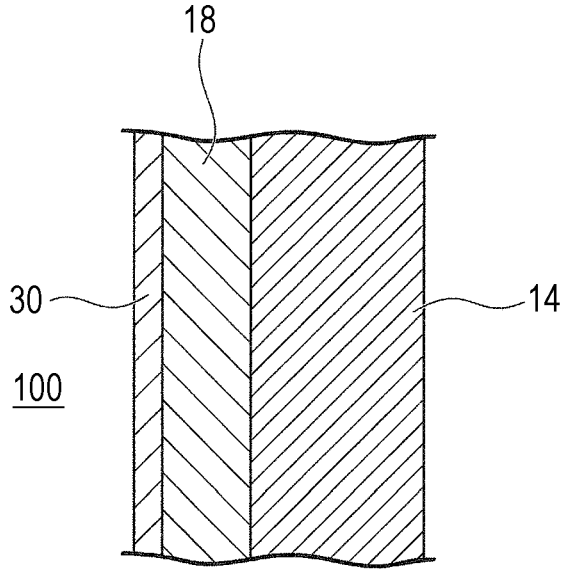
FIG. 18 is an explanatory view illustrating the storage container according to the second embodiment.
Figure 18:
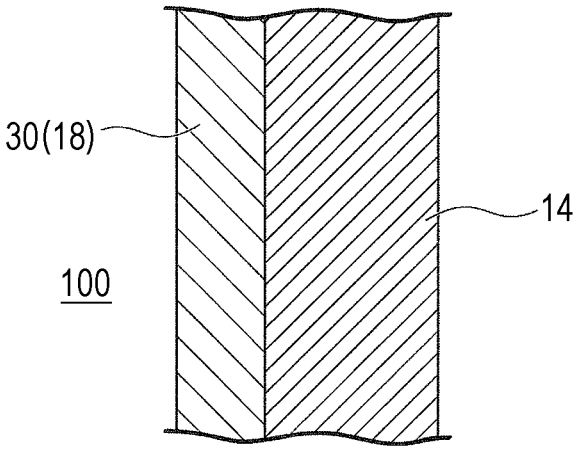

FIGS. 17 and 18 are each an explanatory view of a storage container 4 according to a second embodiment of the present invention. The storage container 4 of the second embodiment is partly in common to the storage container 1 of the first embodiment. Accordingly, components in the second embodiment in common to those in the first embodiment are denoted by the same symbols, and detailed description of those components is omitted.

As illustrated in FIG. 17, the storage container 4 includes a reflecting layer (infrared reflecting layer) 30, which is disposed on the inner wall of the storage room 100 and which reflects infrared rays.

When a user wants to take out any of the preserved goods in the storage room 100 while the operation of the storage container 4, i.e., a refrigerator, is stopped, the user has to open the door 20 and put the hand into the storage room 100. At that time, because the surface temperature of the user's hand is usually higher than the temperature inside the storage room 100, heat flows into the storage room 100 as radiant heat from the user's hand.

Such heat transfer between the user and the inside of the storage room 100 due to radiation caused upon opening of the door 20 can be estimated using the following formula (8).

$$Q=A\cdot\epsilon\cdot\sigma\cdot s\cdot(T_4^4-T_5^4) \tag{8}$$

(Q: inflow amount of heat due to radiation (J), A: surface area ($m^2$), $\epsilon$: emissivity, $\sigma$: Stefan-Boltzmann's constant ($5.67\times10^{-8}$ $(w/(m^2)\cdot K^4)$), s: opening time of the door (s), $T_4$: temperature of the body surface (K), and $T_5$: temperature inside the storage room (K))

Considering radiation from a half surface area (1.8 $m^2$) of a user's body on condition that the surface temperature of the user wearing clothes is 30° C. and the temperature inside the storage room is 6° C., an amount of heat transfer is 109 J/s from the above formula (8). Furthermore, an amount of heat flowing into the storage room is 33 kJ when the door opening time is 30 seconds, and is 66 kJ when the door opening time is 60 seconds.

On the other hand, an amount of heat flowing into the storage room when air in the storage room is entirely replaced with ambient air is 32 kJ (the amount of heat=$140/1000\times\rho\times Cp\times(25-6)$) on an assumption that the volume of the storage room is 140 L, the density of air is $\rho$ (=1.1763 $kg/m^3$), the latent heat of air is Cp (=1007 J/(kg·K)), the ambient air temperature is 25° C., and the temperature inside the storage room is 6° C.

It is hence understood that the radiation from the body surface of the user gives a large influence on the inflow of heat when the door 20 is opened.

The storage container 4 of the second embodiment includes the reflecting layer 30, which is disposed on the inner wall of the storage room 100 and which reflects infrared rays. Thus, when the user takes out any of the preserved goods from the storage room 100 during a period of a power failure, the reflecting layer 30 can reflect infrared rays radiated from the body surface of the user to prevent the radiant heat from flowing into the storage room, and can suppress a temperature rise in the storage room. In addition, during the ordinary operation, the temperature inside the storage room is less apt to rise with the presence of the reflecting layer 30, and hence power consumption can be reduced.

The reflecting layer 30 is made of a material having a relatively low absorbance for the infrared rays radiated from a human body. Those infrared rays have a peak wavelength at about 9.6 μm in accordance with the Wien's displacement law. Because absorbance and reflectance are inversely correlated with each other in accordance with the Kirchhoff's law, a material having a relatively high reflectance for the above-mentioned infrared rays may be used instead. For example, a material reflecting infrared rays, which have a peak wavelength at a wavelength corresponding to the body surface temperature of the human body, at 60% or more is preferably used. One example of such a material is a metal material having light reflectivity like aluminum.

As illustrated in FIG. 18(*a*), the reflecting layer 30 may be disposed on the surface of the casing 18. Alternatively, as illustrated in FIG. 18(*b*), the reflecting layer 30 may constitute a part of the casing 18 and may contact with the heat accumulating portion 14. It is preferable to employ the structure illustrated in FIG. 18(*b*) and to form the reflecting layer 30 using a metal material for the reason that the temperature of cold air inside the storage room 100 during the stationary operation is more apt to be conducted to the heat accumulating portion 14 through the reflecting layer 30 made of the metal material, and the heat accumulating portion 14 is more apt to store the cold and to cause phase transition to a solid phase.

With the storage container 4 thus constructed, even when the user takes out any of the preserved goods from the storage room during a period in which the operation is stopped, a temperature rise in the storage room can be suppressed and the temperature inside the storage room can be maintained not to cause a temperature distribution.

[Third Embodiment]

Figure 19:
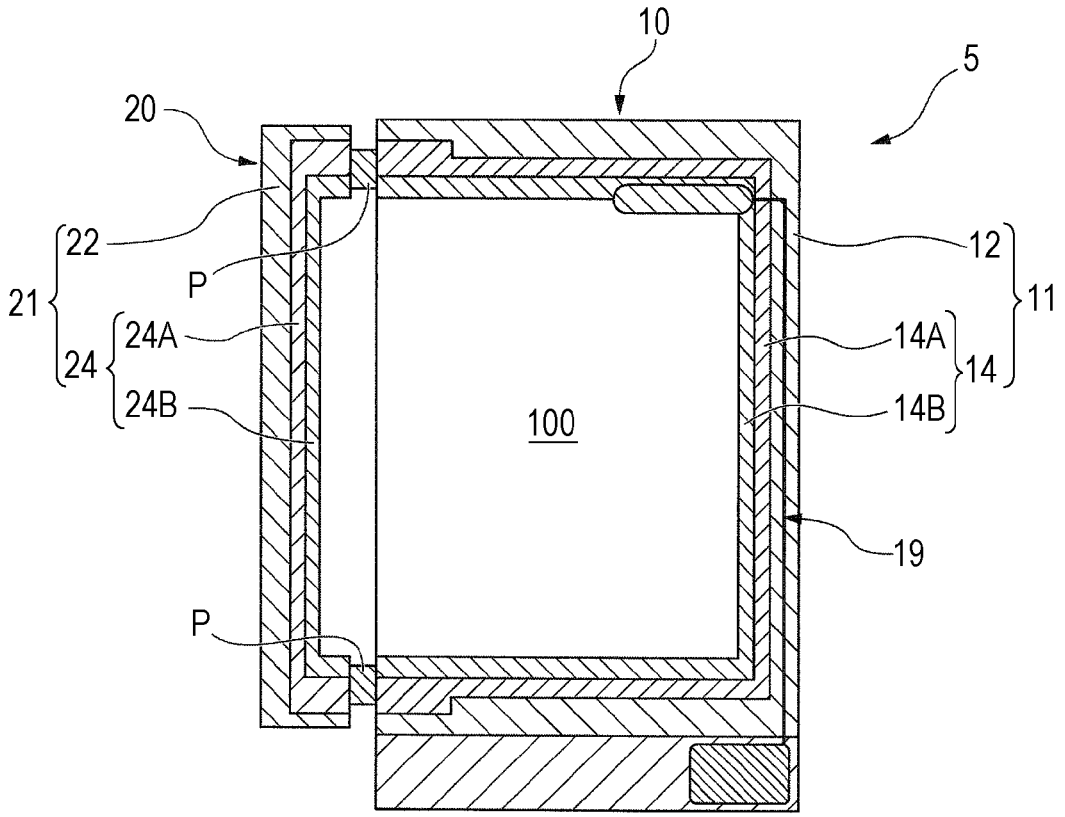
FIG. 19 is an explanatory view illustrating a storage container according to a third embodiment.

FIG. 19 is an explanatory view of a storage container 5 according to a third embodiment of the present invention. The storage container 5 of the third embodiment is partly in common to the storage container 1 of the first embodiment. Accordingly, components in the third embodiment in common to those in the first embodiment are denoted by the same symbols, and detailed description of those components is omitted.

As illustrated in FIG. 19, the heat accumulating portion 14 of the storage container 5 includes a first heat accumulating portion 14B surrounding the storage room 100, and a second heat accumulating portion 14A disposed between the heat insulating portion 12 and the first heat accumulating portion 14B to surround the storage room 100. Furthermore, the heat accumulating portion 24 includes a first heat accumulating portion 24B surrounding the storage room 100, and a second heat accumulating portion 24A disposed between the heat insulating portion 22 and the first heat accumulating portion 24B to surround the storage room 100. The second heat accumulating portions 14A and 24A are made of a material having a phase transition temperature closer to the ambient air temperature than a material of the first heat accumulating portions 14B and 24B.

In the storage container 5 thus constructed, after stop of the operation, cold air is first supplied to the storage room 100 from the first heat accumulating portions 14B and 24B having the relatively low phase transition temperature until the phase transition of the first heat accumulating portions 14B and 24B is completed. Then, cold air is supplied to the storage room 100 from the second heat accumulating portions 14A and 24A having the relatively high phase transition temperature until the phase transition of the second heat accumulating portions 14B and 24B is completed. Accordingly, the phase transition temperature of each of the heat accumulating portions 14 and 24 is set in multiple stages, and the temperature inside the storage room 100 is easier to maintain.

With the storage container 5 constructed as described above, the temperature inside the storage room can be maintained not to cause a temperature distribution.

[Fourth Embodiment]

Figure 20:
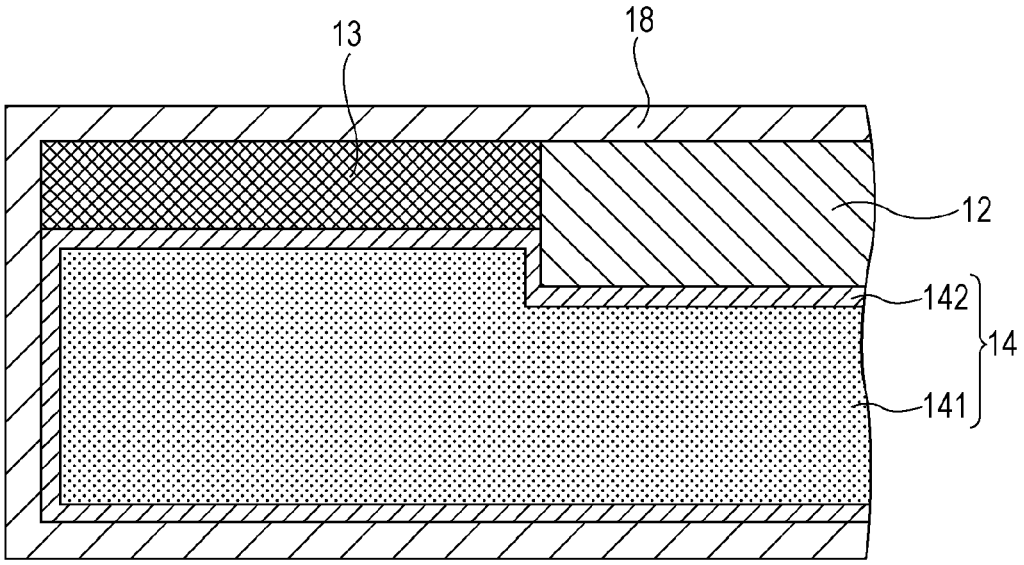
FIG. 20 is an explanatory view illustrating a storage container according to a fourth embodiment.
Figure 20:
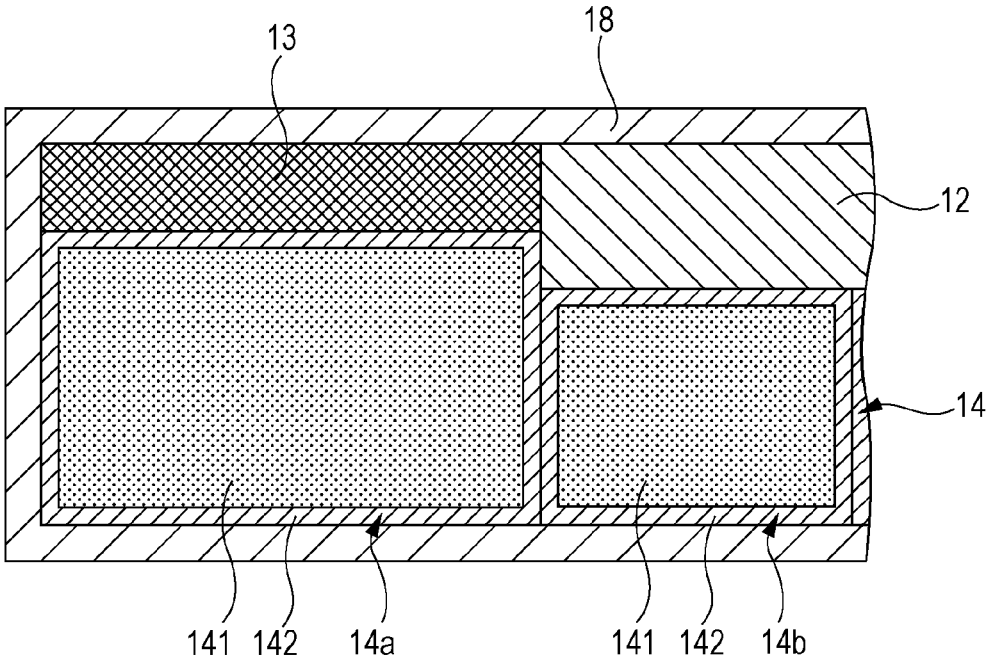

FIG. 20 is an explanatory view of a storage container according to a fourth embodiment of the present invention. The storage container of the fourth embodiment is partly in common to the storage container 1 of the first embodiment. Accordingly, components in the fourth embodiment in common to those in the first embodiment are denoted by the same symbols, and detailed description of those components is omitted.

FIGS. 20(*a*) and 20(*b*) are each an explanatory view illustrating the structure of the wall member 11. As illustrated in FIGS. 20(*a*) and 20(*b*), the heat accumulating portion 14 is disposed to be thickened in the direction of thickness, as viewed from the wall surface of the storage room 100, at a position (denoted by the symbol α in FIG. 1) where the heat accumulating portion 14 is adjacent to the packing P with the casing of the container body 10 or the door 20 interposed therebetween. Accordingly, a heat insulating portion 13 positioned above the heat accumulating portion 14 adjacent to the packing P has a smaller thickness than the heat insulating portion 12 positioned above the heat accumulating portion 14 not adjacent to the packing P.

In a region corresponding to the heat insulating portion 13 where the thickness of the heat insulating material has a relatively small thickness, the amount of inflow heat is increased in comparison with that in other regions, thus causing a situation that the cold keeping performance may become lower in the region where the heat accumulating portion 14 has a larger thickness. It is therefore required to make such a modification that there is no difference in heat insulation performance between the heat insulating portion 12 and the heat insulating portion 13. In this embodiment, the heat insulating portion 13 is made of a vacuum heat insulating material having higher heat insulation performance than urethane foam used in the heat insulating portion 12. As a result, the heat insulation performance of the heat insulating portion 13 can be made equivalent to that of the heat insulating portion 12, and reduction of the cold keeping performance of the heat accumulating portion 14 adjacent to the packing P can be avoided.

[Fifth Embodiment]

Figure 21:
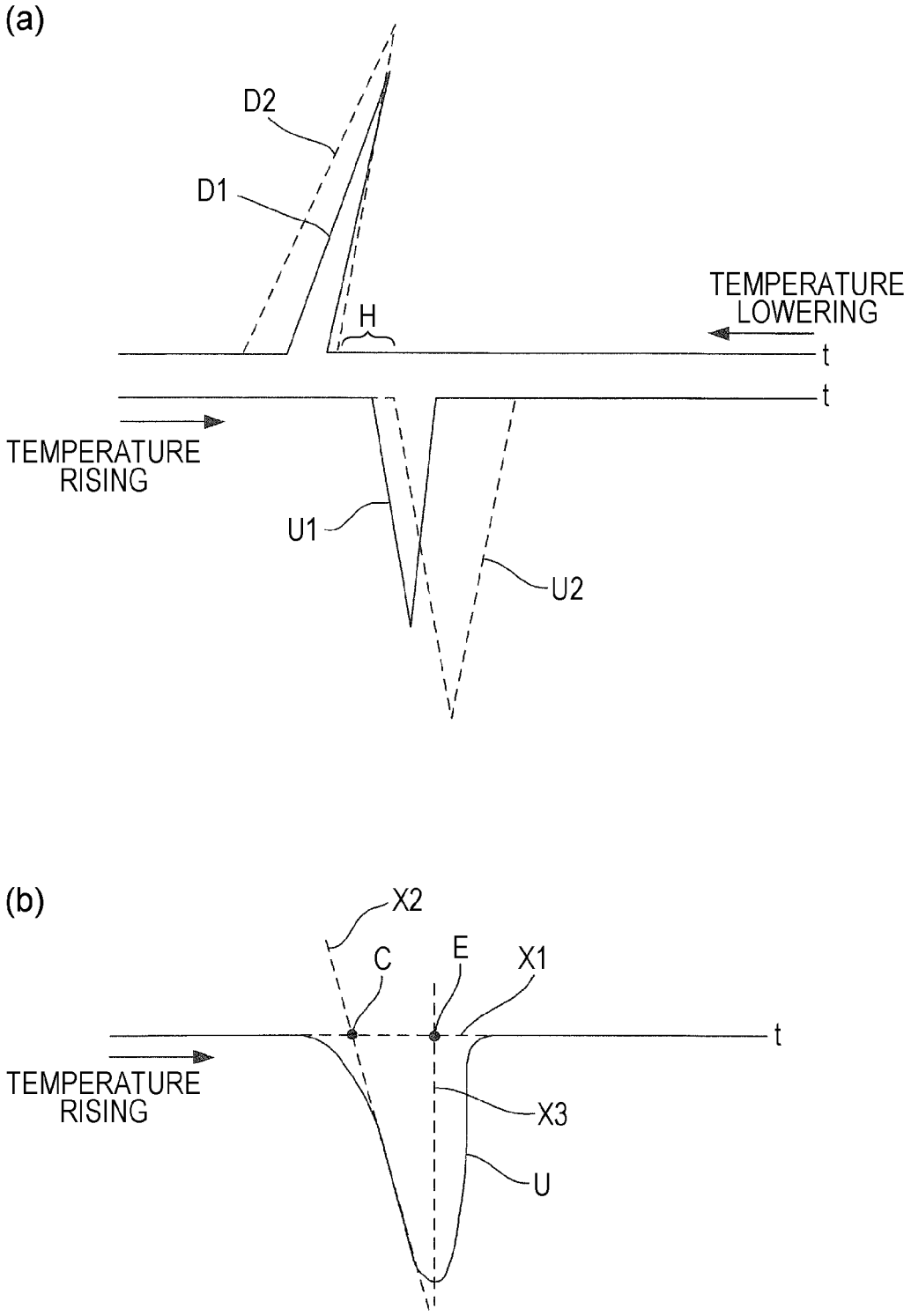
FIG. 21 represents a fifth embodiment and illustrates a manner of determining a phase transition temperature of a heat accumulating material used in the storage container.

FIG. 21 represents a fifth embodiment of the present invention and illustrates a manner of determining the phase transition temperature of the heat accumulating material used in the storage container. FIG. 21(*a*) represents an example of measuring the phase transition temperature of the heat accumulating material using the DSC. In FIG. 21(*a*), the horizontal axis denotes temperature t. The temperature t becomes higher toward the right. There are two horizontal axes. The upper horizontal axis denotes the result of measurement with a temperature lowering process, and the lower horizontal axis denotes the result of measurement with a temperature rising process. The vertical direction denotes an amount of heat. The upper side of the horizontal axis represents an amount of heat released from the heat insulating material, and the lower side represents an amount of heat absorbed by the heat insulating material.

Furthermore, in FIG. 21(*a*), a solid-line waveform D1 denotes the measurement result when a furnace for the DSC is cooled at a predetermined temperature lowering rate (speed), and a dotted-line waveform D2 denotes the measurement result when the furnace is cooled at a higher temperature lowering rate than the predetermined temperature lowering rate. Similarly, a solid-line waveform U1 denotes the measurement result when the furnace for the DSC is heated at a predetermined temperature rising rate, and a dotted-line waveform U2 denotes the measurement result when the furnace is heated at a higher temperature rising rate than the predetermined temperature rising rate.

In the measurement with the DSC, as illustrated in FIG. 21(*a*), a peak temperature changes depending on a difference in each of the temperature lowering rate and the temperature rising rate. Moreover, because the phase transition temperature lowers due to supercooling H in the temperature lowering measurement, hysteresis occurs between the temperature rising process and the temperature lowering process. In the above description of the first embodiment, the temperature lowering rate is set to 1° C./min, and the peak temperature is measured at the time when the phase transition from the liquid phase to the solid phase occurs. In the non-stationary state, however, the peak temperature measured with the DSC changes, as illustrated in FIG. 21(*a*), depending on a difference in the temperature lowering or rising rate, or due to the hysteresis between the temperature rising process and the temperature lowering process. The peak temperature needs to be a temperature at which the heat accumulating material can keep the solid phase state when the heat accumulating material is held cold or within a certain temperature range in the actual storage container. Therefore, the measurement of the phase transition temperature of the heat accumulating material with the DSC is desirably performed by measuring the peak temperature at the time when the phase transition from the solid phase to the liquid phase occurs. It is hence desired that the peak temperature measurement of the phase transition temperature of the heat accumulating material with the DSC is performed as the temperature rising measurement at a relatively low temperature rising rate. As an alternative example, a cooling temperature inside the actually used storage container may be measured.

FIG. 21(*b*) illustrates a method for generally determining the phase change temperature with the DSC based on the temperature rising measurement. In FIG. 21(*b*), the horizontal axis represents temperature t and the vertical direction represents an amount of heat as in FIG. 21(*a*). In FIG. 21(*b*), a solid-line waveform U denotes the measurement result when the furnace for the DSC is heated at a predetermined temperature rising rate. A linear portion of the waveform U before the heat accumulating material starts the phase transition from the solid phase to the liquid phase is extended toward the higher temperature side as an imaginary linear line X1 denoted by a dotted line. Furthermore, a linear portion of the waveform U in a region before reaching a maximum amount of absorbed heat after the heat accumulating material starts the phase transition is extended as an imaginary linear line X2 denoted by a dotted line. The phase change temperature is determined with the DSC as a temperature corresponding to an intersecting point C between the imaginary linear line X1 and the imaginary linear line X2. On the other hand, a linear line denoted by a dotted line extending from the position of the maximum amount of absorbed heat perpendicularly to the imaginary linear line X1 is assumed to be an imaginary linear line X3. On those assumptions, the peak temperature is determined as an intersecting point E between the imaginary linear line X1 and the imaginary linear line X3. The peak temperature thus determined exists within a temperature range in which the heat accumulating material can mostly retain the solid phase state in the actual storage container.

[Sixth Embodiment]

Figure 22:
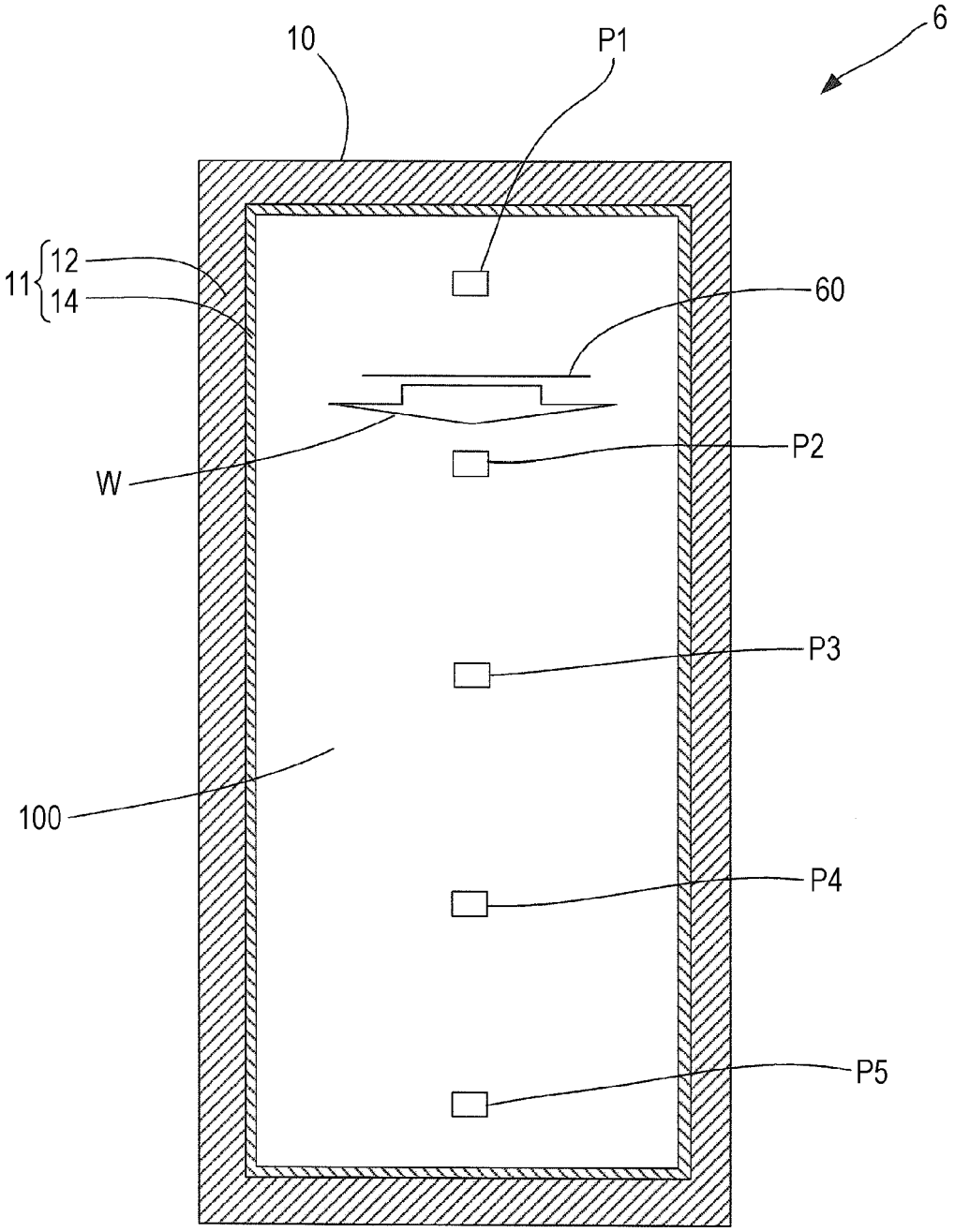
FIG. 22 is an explanatory view illustrating a storage container according to a sixth embodiment.
Figure 23:
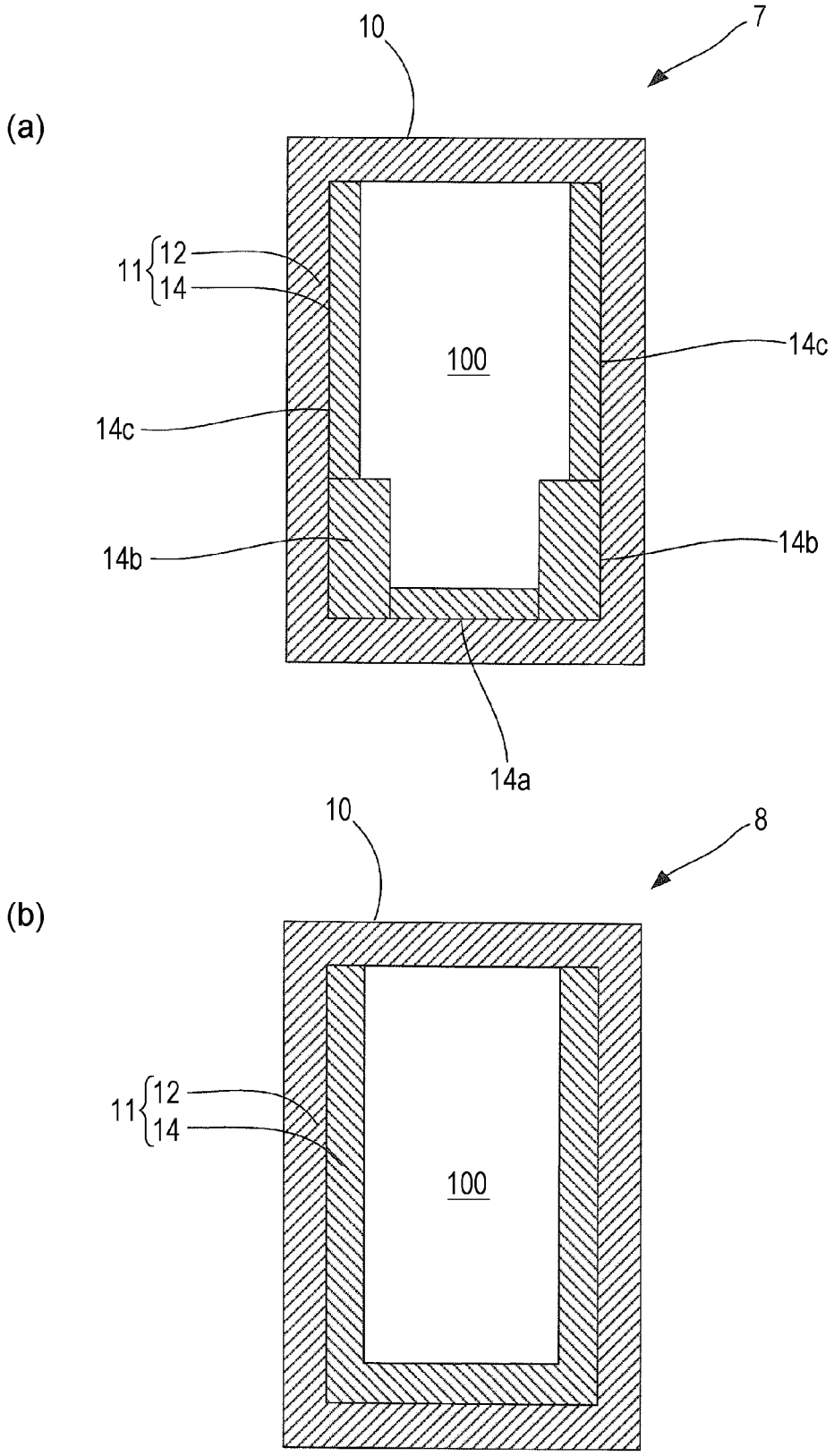
FIG. 23 is an explanatory view illustrating the storage container according to the sixth embodiment.

FIGS. 22, 23(*a*) and 23(*b*) are explanatory views of storage containers 6, 7 and 8 according to a sixth embodiment of the present invention. The storage containers 6, 7 and 8 of the sixth embodiment are each partly in common to the storage container 1 of the first embodiment. Accordingly, components in the sixth embodiment in common to those in the first embodiment are denoted by the same symbols, and detailed description of those components is omitted. FIG. 22 is a sectional view illustrating a state when looking at the storage room 100 from the opening 101 of the storage container 6. In the storage container 6, a cold air outlet 60 is formed in an upper portion of the inner wall of the storage room 100 on the rear side instead of the cooling unit 192. The cold air outlet 60 has an elongate opening extending in the horizontal direction. Cold air is blown out from the elongate opening of the cold air outlet 60 into the storage room 100 at an air speed of, e.g., 10 cm/s in the direction denoted by an arrow W in the drawing.

Five temperature data sampling points P1 to P5 are specified on the inner wall of the storage room 100 on the rear side. The temperature data sampling point P1 is arranged at a center above the cold air outlet 60. The temperature data sampling points P2 to P5 are arranged in a central portion vertically under the cold air outlet 60 to be positioned on a line at equal intervals.

An external appearance of the storage container 6 has a parallelepiped shape with a square bottom surface of 50 (cm)×50 (cm) and a height of 100 cm. The latent heat accumulating material of the heat accumulating portion 14 has latent heat of 50 kJ/kg, specific heat of 1 kJ/(kg·K), and the phase transition temperature of 6° C. The heat insulating portion 12 is made of an urethane board having thermal conductivity of 0.025 W/(m·k) and a wall thickness of 5 cm.

FIG. 23(*a*) illustrates a section when looking at the storage room 100 from the opening 101 of the storage container 7. The storage container 7 has the same structure as the storage container 6 except for arrangement of the heat accumulating portion 14. In the storage container 7 illustrated in FIG. 23(*a*), the cold air outlet 60 and the temperature data sampling points P1 to P5 are omitted from the drawing. The heat accumulating portion 14 of the storage container 7 includes a heat accumulating portion 14*a*, which has a thickness v1 and which is arranged over an inner bottom wall surface of the storage room 100. A heat accumulating portion 14*b* having a larger thickness v2 (>v1) than the heat accumulating portion 14*a* is arranged over each side wall of the storage room 100 up to a position corresponding to about ⅓ of the height of the storage room from the bottom surface. In addition, a heat accumulating portion 14*c* having the same thickness v1 as the heat accumulating portion 14*a* is arranged over each side wall of the storage room 100 to cover a region from the position corresponding to ⅓ of the height on the lower side to an upper inner wall surface of the storage room 100. The heat accumulating material is not disposed at the upper inner wall surface of the storage room 100.

FIG. 23(*b*) illustrates a section when looking at the storage room 100 from the opening 101 of the storage container 8. The storage container 8 has the same structure as the storage containers 6 and 7 except for arrangement of the heat accumulating portion 14. In the storage container 8 illustrated in FIG. 23(*b*), the cold air outlet 60 and the temperature data sampling points P1 to P5 are omitted from the drawing. As the heat accumulating portion 14 of the storage container 8, a heat accumulating portion 14*a* having a thickness v3 is arranged entirely over the inner bottom wall surface and the side wall surfaces of the storage room 100. The thickness v3 is larger than the thickness v1, but smaller than the thickness v2. The heat accumulating material is not disposed at the upper inner wall surface of the storage room 100. Total weight of the heat accumulating material used in the storage container 8 is set equal to that of the heat accumulating material used in the storage container 7.

Thus, the storage container 7 and the storage container 8 are in common to each other in that the heat accumulating materials in both the storage containers have the same total weight, and the heat accumulating material is not disposed at the upper inner wall surface of the storage room 100. The storage containers 7 and 8 are different in that the heat accumulating material in the storage container 8 is arranged substantially in a uniform thickness, while the heat accumulating material in the storage container 7 is arranged to have such a distribution in thickness as having a larger thickness in the heat accumulating material on each side wall near the bottom of the storage room than in the heat accumulating material positioned above the former.

For the two storage containers 7 and 8 in which the heat accumulating material is arranged on the inner wall of the storage room 100 in different distributions, a time during which the temperature inside the storage room 100 can be held at 10° C. has been determined by a thermo-fluid analysis. The analysis has been performed on two cases where the ambient air temperature around an installation place of the storage containers 7 and 8 is 30° C. and 40° C. An initial temperature inside the storage room 100 is set to 0° C. Such an initial temperature is obtained by cooling the storage room 100 for 10 hours with cold air of 0° C. supplied from the cold air outlet 60. The storage room 100 is enclosed and is subjected to only natural convection without including any heat source.

Figure 24:
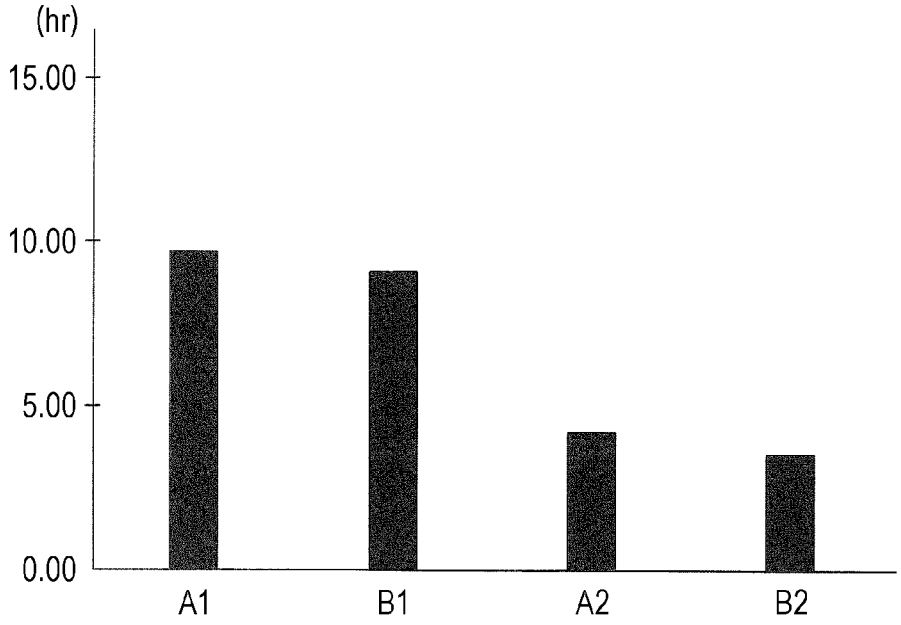
FIG. 24 illustrates the analysis results for the storage container according to the sixth embodiment.
Figure 24:
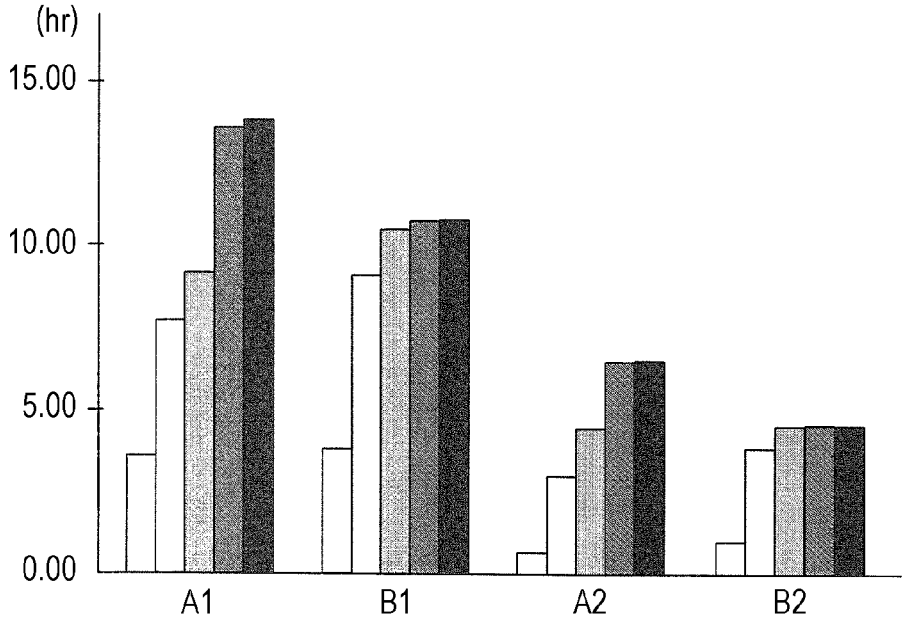

FIG. 24 is a graph depicting the analysis result. More specifically, FIG. 24(*a*) is a bar graph depicting an average retention time during which the temperature inside the storage room 100 can be held at 10° C. FIG. 24(*b*) is a bar graph depicting a positional distribution of the retention time during which the temperature inside the storage room 100 can be held at 10° C. In each of those graphs, the vertical axis denotes time. An A1 group represents the result when the ambient air temperature around the storage container 7 is 30° C. An A2 group represents the result when the ambient air temperature around the storage container 7 is 40° C. A B1 group represents the result when the ambient air temperature around the storage container 8 is 30° C. A B2 group represents the result when the ambient air temperature around the storage container 8 is 40° C. In FIG. 24(*b*), five retention times in each group correspond respectively to the results obtained at the temperature data sampling points P1 to P5 in order when viewed from the left to the right. The average retention time in each of the groups in FIG. 24(*a*) implies an average value of the retention times obtained at the temperature data sampling points P1 to P5 in the corresponding group in FIG. 24(*b*).

The following matters are understood from the graph of FIG. 24(*a*). First, the average retention time during which the temperature inside the storage room 100 can be held at 10° C. is slightly longer in the storage container 7 corresponding to the groups A1 and A2 than in the storage container 8 corresponding to the groups B1 and b2. Furthermore, when the ambient air temperature is 30° C., the average retention time of about 9 hours is obtained in both the storage containers 7 and 8. In both the storage containers 7 and 8, the average retention time obtained at the ambient air temperature of 30° C. is longer about twice that obtained at the ambient air temperature of 40° C.

The following matters are understood from the graph of FIG. 24(*b*). First, the retention time during which the temperature inside the storage room 100 can be held at 10° C. is longest at the temperature data sampling point P5 and is shortest at the temperature data sampling point P1 in both the storage containers 7 and 8. Furthermore, the retention time gradually shortens in order of the temperature data sampling points P4, P3 and P2. When the ambient air temperature is 30° C., the temperature in the upper portion of the storage room exceeds 10° C. after the lapse of 4 hours and unevenness in temperature occurs between the upper portion of the storage room and other portions below the upper portion in both the storage containers 7 and 8. When the ambient air temperature is 40° C., the temperature in the upper portion of the storage room exceeds 10° C. after the lapse of 1 hour and unevenness in temperature occurs between the upper portion of the storage room and other portions below the upper portion in both the storage containers 7 and 8.

In accordance with the above-described analysis, the manufacturing cost can be reduced by cutting a quantity of materials used as the heat accumulating material. Moreover, when the heat accumulating material cannot be arranged in some parts due to structural restriction of the storage container, the heat accumulating material can be disposed in optimum arrangement.

[Seventh Embodiment]

Figure 25:
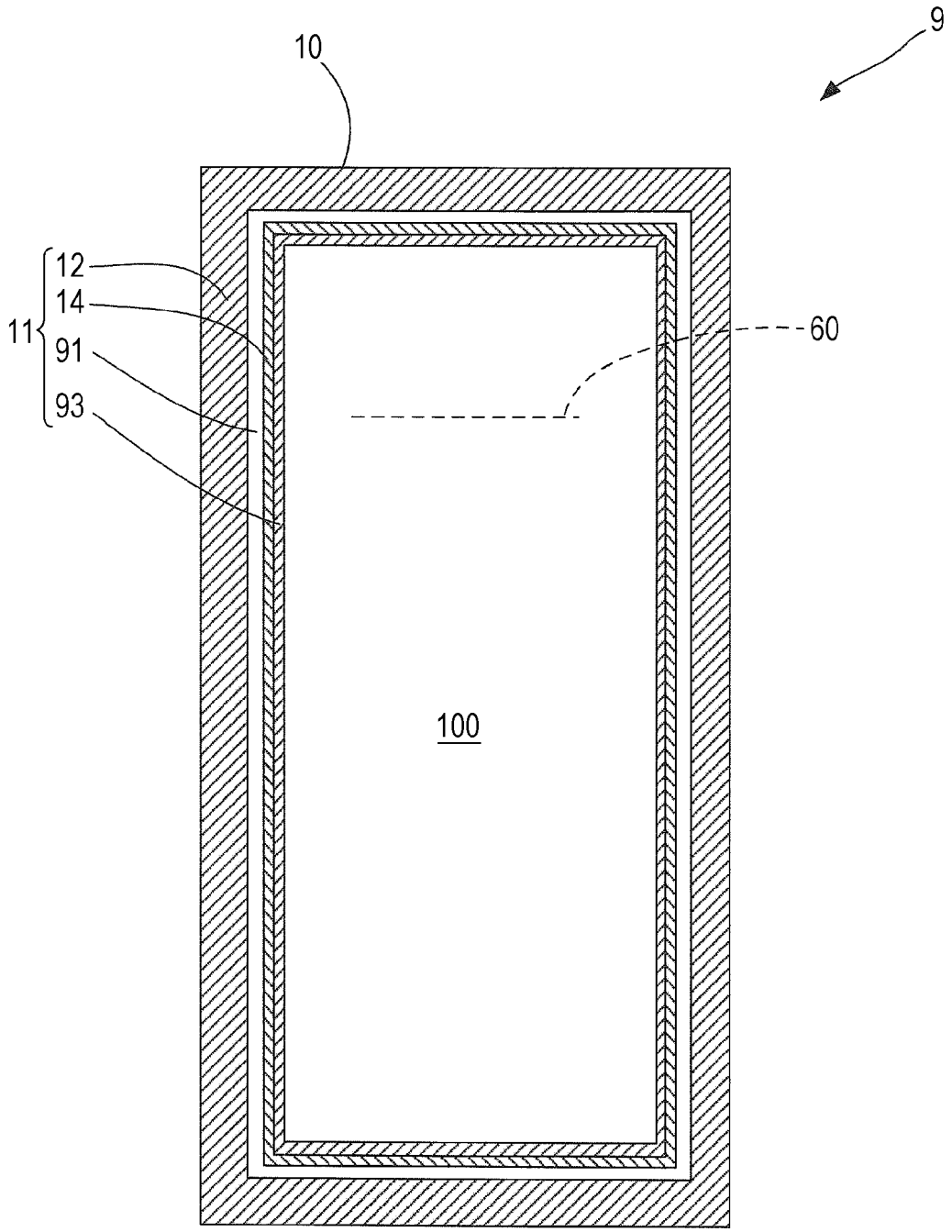
FIG. 25 is an explanatory view illustrating a storage container according to a seventh embodiment.
Figure 26:
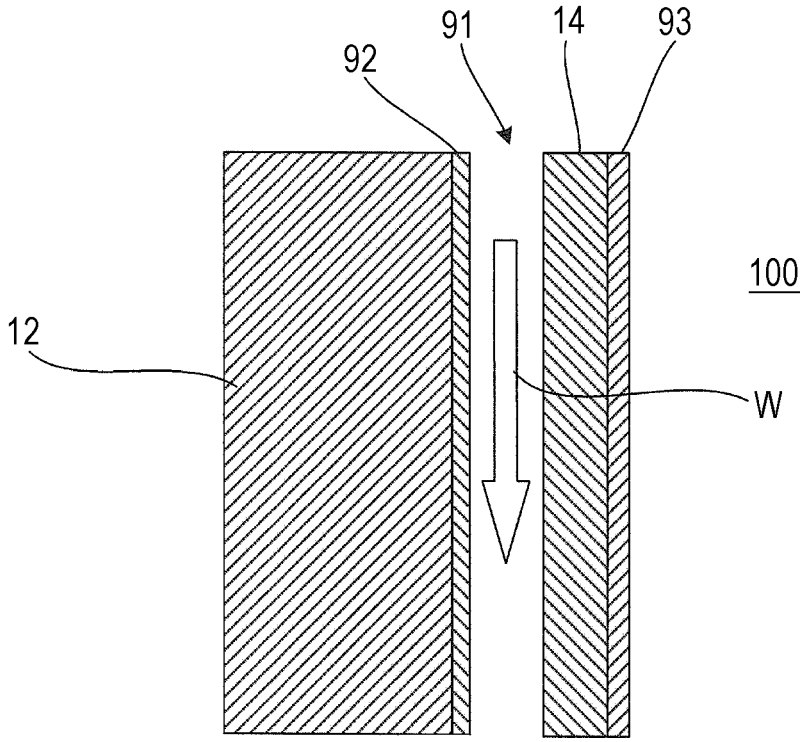
FIG. 26 is an explanatory view illustrating the storage container according to the seventh embodiment.

FIGS. 25 and 26 are explanatory views of a storage container 9 according to a seventh embodiment of the present invention. The storage container 9 of the seventh embodiment is partly in common to the storage container 6 of the sixth embodiment. Accordingly, components in the seventh embodiment in common to those in the sixth embodiment are denoted by the same symbols, and detailed description of those components is omitted.

FIG. 25 is a sectional view illustrating a state when looking at the storage room 100 from the opening 101 of the storage container 9. FIG. 26 illustrates a partial section of the wall member 11 of the storage container 9 in detail. As illustrated in FIGS. 25 and 26, the wall member 11 includes the heat insulating portion 12, an inner wall portion 92, a space portion 91, the heat accumulating portion 14, and a heat reflecting panel 93, which are arranged in the mentioned order in a direction toward the storage room 100 from the ambient air side. With such a structure, a space in the storage room 100 surrounded by the heat reflecting panel 93 serves an actual storage region for the preserved goods. In addition, another wall portion may be disposed between the space portion 91 and the heat accumulating portion 14. Such an arrangement can increase a degree of sealing for the heat accumulating material and can provide stability for a long period.

In the storage container 9, as illustrated in FIG. 25, the cold air outlet 60 is formed in an upper region of the inner wall portion 92 on the rear side. The cold air outlet 60 has an elongate opening extending in the horizontal direction. Cold air is blown out from the elongate opening of the cold air outlet 60 and is circulated through the space portion 91 at an air speed of, e.g., 10 cm/s in the direction denoted by an arrow W, as illustrated in FIG. 26. In the storage container 9, therefore, the cold air from the cold air outlet 60 is not directly blown to the preserved goods unlike the storage container 6. As a result, excessive drying of the preserved goods can be suppressed.

Moreover, since the heat accumulating portion 14 is exposed to the space portion 91, the cold air circulating through the space portion 91 can directly cool the heat accumulating portion 14. Accordingly, the heat accumulating portion 14 can be cooled in a shorter time with lower poser consumption. In addition, since the heat accumulating portion 14 is directly attached almost over the entire surface of the heat reflecting panel 93, the heat reflecting panel 93 can be uniformly cooled with the heat accumulating portion 14. As a result, the heat reflecting panel 93 can serve to cool the entire storage room at a uniform temperature without unevenness.

[Eighth Embodiment]

Figure 27:
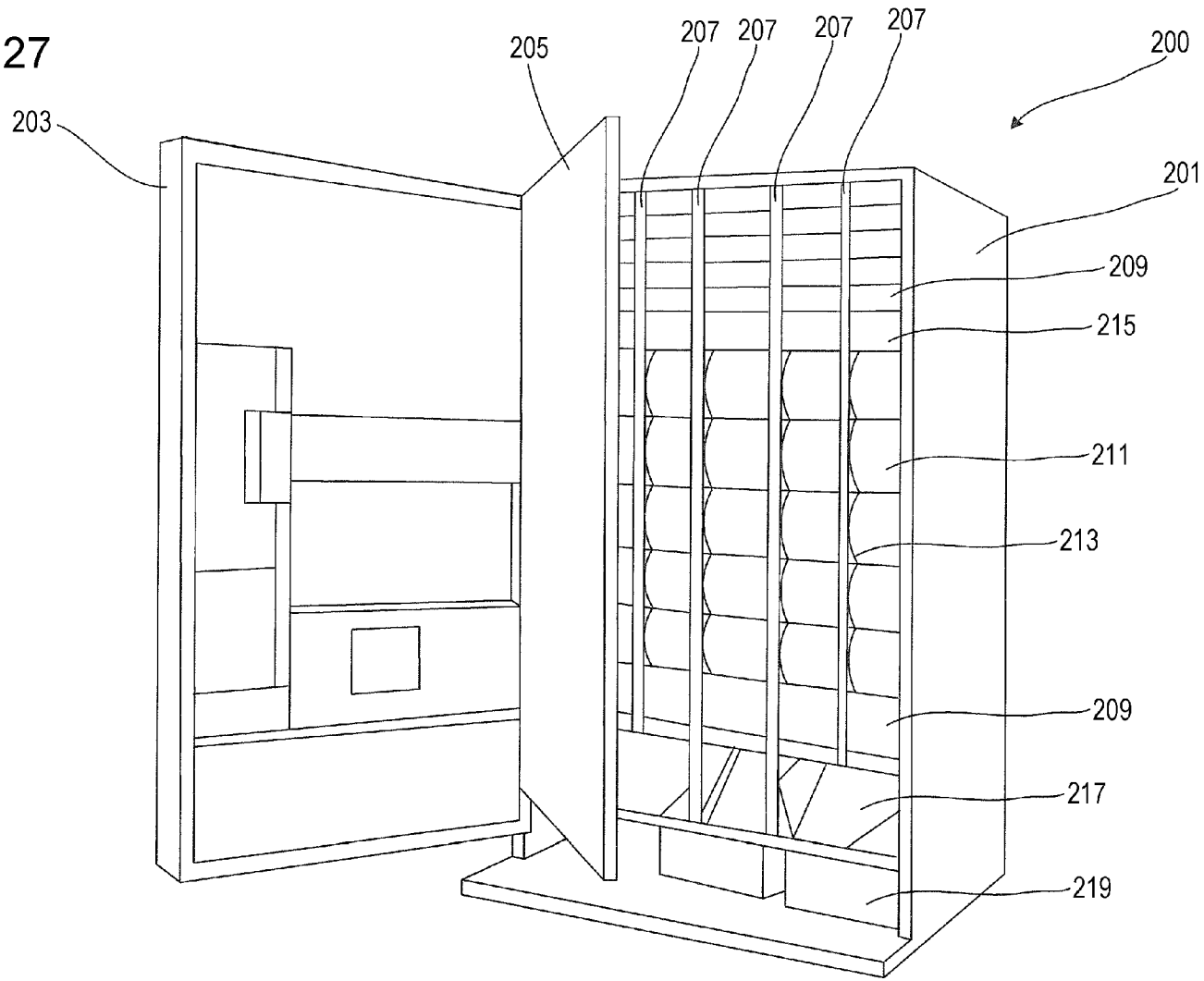
FIG. 27 is an explanatory view illustrating a storage container according to an eighth embodiment.

FIG. 27 is an explanatory view of a storage container according to an eighth embodiment of the present invention. The eighth embodiment is described below in connection with the case where the storage container is a vending machine 200. The vending machine 200 includes a cabinet 201, an inner door 205, and an outer door 203. The inner door 205 is attached to the cabinet 201 by a hinge mechanism (not illustrated) in a state capable of being opened and closed. The outer door 203 is attached to the cabinet 201 by a hinge mechanism (not illustrated) in a state capable of being opened and closed while the inner door 205 is positioned inside the outer door 203. Commodity samples, commodity select buttons, price indicators, cash inlets, a change outlet, commodity outlets, etc. are arranged on the surface side of the outer door 203. The inner door 205 includes a heat insulating material. FIG. 27 illustrates a state where the inner door 205 and the outer door 203 are released from the cabinet 201.

The cabinet 201 includes heat insulating materials disposed in inner wall portions of a metal-made casing. Inward of the heat insulating materials, plural stages of commodity racks 211 for containing commodities are arranged in regions defined by a plurality of vertical partition walls 207 and two horizontal partition walls 209 and 209. Commodity charging openings 215 are arranged above the commodity rack 211 at the uppermost stage. Commodity discharging openings 217 are arranged under the commodity rack 211 at the lowermost stage.

Heat accumulating portions 213 are stuck to peripheral walls of the commodity racks 211. The heat accumulating portions 213 are made of a heat accumulating material that has the heat accumulation performance capable of maintaining temperature at a desired cooling temperature for a predetermined time. For example, any of the heat accumulating materials described in the first to seventh embodiments can be used for the heat accumulating portion 213. A cooling mechanism 219 for cooling the commodity racks 211 and the heat accumulating portions 213 is disposed under the commodity discharging openings 217.

An energy-saving vending machine is known as one of the measures for electrical load leveling. In the energy-saving vending machine, the cooling mechanism 219 is operated in such a manner that a daily operation mode is divided into threes, i.e., an ordinary operation mode, a peak shift mode, and a peak cut mode. The peak shift mode is executed in a time zone of 10:00 to 13:00, for example. In the peak shift mode, cooling operation is performed at a lower temperature than the setting temperature during the ordinary operation mode. The peak cut mode is executed in a time zone of 13:00 to 16:00, for example. In such a time zone, the operation of the cooling mechanism 219 is stopped.

In contrast, in the vending machine 200 according to this embodiment, the peak shift mode can be omitted to be displaced with the peak cut mode by selecting the heat accumulating material of the heat accumulating portions 213 disposed around the commodity racks 211 such that the heat accumulating material is held in a solid phase state in the ordinary operation mode. It is hence possible to achieve more power saving than with the energy-saving vending machine of related art. When the heat accumulating material of the heat accumulating portions 213 disposed around the commodity racks 211 is selected such that the heat accumulating material is held in a solid phase state in the peak shift mode, a duration time of the peak cut mode can be prolonged. This can also achieve more power saving than with the energy-saving vending machine of related art.

It is further possible to raise the temperature in the commodity racks 211 and to sell warm commodities by incorporating a heating mechanism in the vending machine 200 and by replacing the material of the heat accumulating portions 213 with that one having the phase transition temperature usable in a temperature range for a heating cabinet.

It is no needless to say that, while the preferable embodiments of the present invention have been described above with reference to the accompanying drawings, the present invention is not limited to those embodiments. The various shapes, combinations, etc. of the components in the foregoing embodiments are illustrated by way of example, and they can be variously modified in accordance with demands from the viewpoint of design within the scope not departing from the gist of the present invention.

INDUSTRIAL APPLICABILITY

The present invention can be widely applied to the field of storage containers for storing preserved goods at temperatures different from the ambient air temperature.

REFERENCE SIGNS LIST

1 to 9 storage containers
10 storage body
11 and 21 wall members
12, 13 and 22 heat insulating portions
14 and 24 heat accumulating portions
18 casing
20 door (lid)
30 reflecting layer (infrared reflecting layer)
100 storage room
101 opening
AR1 first area
AR2 second area
P packing
D1, D2, U, U1 and U2 waveforms

The invention claimed is:

1. A storage container storing preserved goods and having an electrical cooling function, the storage container including a container body and a lid capable of optionally opening and closing a space in the container body, wherein the space enclosed by the container body and the lid forms a storage room for storing the preserved goods, each of the container body and the lid has a heat insulating portion disposed to surround the storage room and a heat accumulating portion at least partly disposed between the storage room and the heat insulating portion, the heat accumulating portion is made of at least one type of material that causes phase transition between a liquid phase and a solid phase at a temperature between a controllable temperature inside the storage room during a stationary operation and a living environmental temperature around the storage room, and a value obtained by dividing temperature conductivity of the material by an amount of the material used per unit area of a wall surface of the storage room is smaller in the heat accumulating portion arranged near a first area where a temperature is more apt to come closer to the living environmental temperature under a temperature distribution that is formed inside the storage room with changes over time after the electrical cooling function is stopped in a stationary operation state, than in the heat accumulating portion arranged near a second area where a temperature is less apt to come closer to the living environmental temperature under the temperature distribution.

2. The storage container according to claim 1, wherein, based on a relation between a dimensionless temperature and a Fourier number of a wall material constituting the container body and the lid, the dimensionless temperature being defined as a value resulting from dividing a difference between an allowable temperature that is a temperature inside the storage room after stop of the electrical cooling function and that is allowed as a temperature at which the preserved goods can be stored, and the living environmental temperature by a difference between the aforesaid controllable temperature and the living environmental temperature, a thickness of the heat accumulating portion is specified corresponding to a temperature retainable time during which the temperature inside the storage room changes from the aforesaid controllable temperature to the aforesaid allowable temperature after stop of the operation.

3. The storage container according to claim 2, wherein the storage container is a refrigerator, and the allowable temperature is 10° C. or below.

4. The storage container according to claim 2, wherein the storage container is a freezer, and the allowable temperature is −10° C. or below.

5. The storage container according to claim 2, wherein the temperature retainable time is 2 hours to 24 hours.

6. The storage container according to claim 1, wherein the heat accumulating portion is made of plural types of materials, and the material of the heat accumulating portion disposed near the first area has smaller temperature conductivity at a phase transition temperature than the material of the heat accumulating portion disposed near the second area.

7. The storage container according to claim 1, wherein the heat accumulating portion disposed near the first area is disposed to have a larger total amount of latent heat than the heat accumulating portion disposed near the second area.

8. The storage container according to claim 1, wherein the first area is a contact portion between the container body and the lid when the lid is closed.

9. The storage container according to claim 1, wherein the first area is a ceiling portion of the storage room.

10. A storage container storing preserved goods and having an electrical cooling function, the storage container including a container body and a lid capable of optionally opening and closing a space in the container body, wherein the space enclosed by the container body and the lid forms a storage room for storing the preserved goods, each of the container body and the lid has a heat insulating portion disposed to surround the storage room and a heat accumulating portion at least partly disposed between the storage room and the heat insulating portion, the heat accumulating portion is made of at least one type of material that causes phase transition between a liquid phase and a solid phase at a temperature between a controllable temperature inside the storage room during a stationary operation and a living environmental temperature around the storage container, and based on a relation between a dimensionless temperature and a Fourier number of a wall material constituting the container body and the lid, the dimensionless temperature being defined as a value resulting from dividing a difference between an allowable temperature that is a temperature inside the storage room after stop of the electrical cooling function and that is allowed as a temperature at which the preserved goods can be stored, and the living environmental temperature by a difference between the aforesaid controllable temperature and the living environmental temperature, a thickness of the heat accumulating portion in a region occupying a maximum area in the storage container is specified corresponding to a temperature retainable time during which the temperature inside the storage room changes from the aforesaid controllable temperature to the aforesaid allowable temperature after stop of the electrical cooling function.

11. The storage container according to claim 10, wherein the storage container is a refrigerator, and the allowable temperature is 10° C. or below.

12. The storage container according to claim 10, wherein the storage container is a freezer, and the allowable temperature is −10° C. or below.

13. The storage container according to claim 10, wherein the temperature retainable time is 2 hours to 24 hours.

14. The storage container according to claim 1, wherein a peak temperature of a phase transition temperature when the aforesaid material is solidified is −20° C. to −10° C.

15. The storage container according to claim 1, wherein a peak temperature of a phase transition temperature when the aforesaid material is solidified is 0° C. to 10° C.

16. The storage container according to claim 1, wherein a phase transition temperature zone of the aforesaid material when the phase transition occurs from the liquid phase to the solid phase between a setting temperature of the storage room during the stationary operation and the living environmental temperature is 2° C. or below.

17. The storage container according to claim 1, wherein the heat accumulating portion includes a first heat accumulating portion disposed to surround the storage room, and a second heat accumulating portion disposed between the heat insulating portion and the first heat accumulating portion to surround the storage room, and a material of the second heat accumulating portion has a phase transition temperature closer to the living environmental temperature than a material of the first heat accumulating portion.

18. The storage container according to claim 1, wherein a phase transition temperature of the aforesaid material is lower than the living environmental temperature, and at least a part of an inner wall of the storage room is covered with an infrared reflecting layer that reflects 60% or more of infrared rays having a peak wavelength at a wavelength corresponding to a surface temperature of a human body.

19. The storage container according to claim 18, wherein the infrared reflecting layer is made of a metal material, and at least a part of the inner wall of the storage room is made of the metal material to serve as the infrared reflecting layer and is contacted with the heat accumulating portion.

* * * * *